US007013527B2

(12) United States Patent
Thomas, Sr. et al.

(10) Patent No.: US 7,013,527 B2
(45) Date of Patent: Mar. 21, 2006

(54) FLOOR CLEANING APPARATUS WITH CONTROL CIRCUITRY

(75) Inventors: Victor W. Thomas, Sr., Racine, WI (US); Robert K. Kay, Butternut, WI (US); Jayant Sharma, Racine, WI (US); Phillip R. Mass, Boston, MA (US); Rosario Robert, Cambridge, MA (US); Colin Angle, Watertown, MA (US); Lee F. Sword, Methuen, MA (US); Joseph L. Jones, Acton, MA (US); Paul E. Sandin, Randolph, MA (US); John P. O'Brien, Brighton, MA (US); Benjamin L. Wirz, Groton, MA (US); Selma Slipichevich, Chelmsford, MA (US); Mark Chiappetta, Shelton, CT (US); Gideon Coltof, Allston, MA (US)

(73) Assignee: JohnsonDiversey, Inc., Sturtevant, WI (US)

( * ) Notice: Subject to any disclaimer, the term of this patent is extended or adjusted under 35 U.S.C. 154(b) by 0 days.

(21) Appl. No.: 10/934,284

(22) Filed: Sep. 3, 2004

(65) Prior Publication Data

US 2005/0028316 A1 Feb. 10, 2005

Related U.S. Application Data

(60) Continuation of application No. 10/619,150, filed on Jul. 14, 2003, which is a division of application No. 09/588,414, filed on Jun. 6, 2000, now abandoned.

(60) Provisional application No. 60/138,179, filed on Jun. 8, 1999.

(51) Int. Cl.
*A47L 11/29* (2006.01)

(52) U.S. Cl. ..... 15/319; 15/320; 15/339; 15/340.3; 15/4; 15/50.3; 15/98

(58) Field of Classification Search ..... 15/4, 15/50.1, 50.3, 52, 98, 320, 340.1, 340.3, 15/319, 339

See application file for complete search history.

(56) References Cited

U.S. PATENT DOCUMENTS

| | | | |
|---|---|---|---|
| 901,978 A | 10/1908 | Mally et al. | |
| 2,622,254 A | 12/1952 | Mendelson | 15/52 |
| 3,197,798 A | 8/1965 | Brown et al. | |

(Continued)

FOREIGN PATENT DOCUMENTS

| | | |
|---|---|---|
| EP | 0569984 A1 | 11/1993 |
| EP | 0951858 A1 | 10/1999 |
| WO | WO 93/18699 | 9/1993 |

(Continued)

OTHER PUBLICATIONS

Brooks, Rodney A., "The Behavior Language; User's Guide", Massachusetts Institute of Technology Artificial Intelligence Laboratory, pp. 1–34, Apr. 1990.

Brooks, Rodney A., "Integrated Systems Based on Behaviors", Massachusetts Institute of Technology Artificial Intelligence Laboratory, pp. 1–5.

(Continued)

*Primary Examiner*—Theresa T. Snider
(74) *Attorney, Agent, or Firm*—James J. Sales; Gregory S. Bollis; Neil E. Hamilton

(57) ABSTRACT

A floor cleaner is provided for cleaning a floor, where the floor cleaner has a front and a rear and includes: a sweeper for sweeping the floor, a scrubber, connected to the sweeper and located in the rear of the sweeper, for wetting and cleaning the floor; and a burnisher, connected to the scrubber and located in the rear of the scrubber, for burnishing the floor.

9 Claims, 25 Drawing Sheets

U.S. PATENT DOCUMENTS

| | | | | |
|---|---|---|---|---|
| 3,204,280 | A | 9/1965 | Cambell | |
| 3,742,546 | A | 7/1973 | Crener et al. | 15/320 |
| 3,795,933 | A | 3/1974 | Seufert | 15/114 |
| 3,921,244 | A | 11/1975 | Warren et al. | 15/98 |
| 3,931,659 | A | 1/1976 | Pfefferkorn et al. | 15/246 |
| 3,942,215 | A | 3/1976 | Olds | 15/320 |
| 3,952,361 | A | 4/1976 | Wilkins | 15/319 |
| 3,972,088 | A | 8/1976 | Thomas | 15/4 |
| 4,059,863 | A | 11/1977 | Deuchar et al. | 15/98 |
| 4,094,034 | A | 6/1978 | Wilkins et al. | |
| 4,096,084 | A | 6/1978 | Thomsen et al. | |
| 4,114,711 | A | 9/1978 | Wilkins | 15/319 |
| 4,118,819 | A | 10/1978 | Gordon et al. | |
| 4,122,576 | A | 10/1978 | Bevington et al. | 15/98 |
| 4,150,456 | A | 4/1979 | Alvarez et al. | 15/246 |
| 4,214,337 | A | 7/1980 | Nise et al. | |
| 4,237,571 | A | 12/1980 | Nelson | |
| 4,295,243 | A | 10/1981 | King | 15/320 |
| 4,322,920 | A | 4/1982 | Wells | 15/246 |
| 4,380,844 | A | 4/1983 | Waldhauser et al. | 15/320 |
| 4,393,534 | A | 7/1983 | Lee et al. | 15/98 |
| 4,492,002 | A | 1/1985 | Waldhauser et al. | 15/320 |
| 4,506,405 | A | 3/1985 | Block | 15/320 |
| 4,577,364 | A | 3/1986 | Demetriades | 15/320 |
| 4,633,541 | A | 1/1987 | Block | 15/320 |
| 4,783,872 | A | 11/1988 | Burhoe | 15/98 |
| 4,790,402 | A | 12/1988 | Field et al. | |
| 4,819,676 | A | 4/1989 | Blehert et al. | 15/349 |
| 4,825,500 | A | 5/1989 | Basham et al. | 15/319 |
| 4,910,824 | A | 3/1990 | Nagayama et al. | 15/98 |
| 4,940,082 | A | 7/1990 | Roden | 15/321 |
| 4,958,068 | A | 9/1990 | Pong et al. | |
| 5,020,620 | A | 6/1991 | Field | |
| 5,032,775 | A | 7/1991 | Mizuno et al. | |
| 5,064,010 | A | 11/1991 | Masbruch et al. | 15/340.2 |
| 5,093,955 | A | 3/1992 | Blehert et al. | 15/320 |
| 5,148,573 | A | 9/1992 | Killian et al. | 15/339 |
| 5,212,848 | A | 5/1993 | Geyer | 15/401 |
| 5,253,384 | A | 10/1993 | Joines et al. | 15/98 |
| 5,254,146 | A | 10/1993 | Beaufoy | 15/340.3 |
| 5,287,581 | A | 2/1994 | Lo | 15/52 |
| 5,289,605 | A | 3/1994 | Armbruster | 15/97.1 |
| 5,293,955 | A | 3/1994 | Lee | 15/319 |
| 5,307,273 | A | 4/1994 | Oh et al. | |
| 5,371,912 | A | 12/1994 | Hall | 15/98 |
| 5,402,051 | A | 3/1995 | Fujiwara et al. | |
| 5,402,559 | A | 4/1995 | Allison et al. | 15/228 |
| 5,440,216 | A | 8/1995 | Kim | 15/319 |
| 5,454,138 | A | 10/1995 | Mondigo et al. | 15/354 |
| 5,467,500 | A | 11/1995 | O'Hara et al. | 15/320 |
| 5,534,762 | A | 7/1996 | Kim | 15/340.1 |
| 5,548,511 | A | 8/1996 | Bancroft | 15/319 |
| 5,566,422 | A | 10/1996 | Geyer | 15/320 |
| 5,611,105 | A | 3/1997 | Blehert et al. | 15/320 |
| 5,613,261 | A | 3/1997 | Kawakami et al. | 15/98 |
| 5,621,291 | A | 4/1997 | Lee | |
| 5,623,743 | A | 4/1997 | Burgoon et al. | 15/320 |
| 5,636,402 | A | 6/1997 | Kubo et al. | 15/98 |
| 5,646,494 | A | 7/1997 | Han | |
| 5,742,975 | A | 4/1998 | Knowlton et al. | 15/320 |
| 5,815,880 | A | 10/1998 | Nakanishi | 15/319 |
| 5,940,928 | A | 8/1999 | Erko | 15/319 |
| 6,023,813 | A | 2/2000 | Thatcher et al. | 15/320 |
| 6,357,070 | B1 | 3/2002 | Venard et al. | 15/50.1 |

FOREIGN PATENT DOCUMENTS

| | | |
|---|---|---|
| WO | WO 95/09557 | 4/1995 |
| WO | WO 01/60227 A1 | 8/2001 |

OTHER PUBLICATIONS

Evans, John M., "HelpMate: a service robot success story", Service Robot: An International Journal, vol. 1, No. 1, MCB University Press, pp. 19–21, (1995).

Hofner, Christian and Gunther Schmidt, "Path Planning And Guidance Techniques For An Autonomous Mobile Cleaning Robot", Department for Automatic Control Engineering (LSR) Technische Universitat Munchen, Germany, pp. 610–617.

Jenkins, Frank, "Practical Requirements for a Domestic Vacuum–Cleaning Robot", JRL Consulting, P.O. Box 1289, Menlo Park, CA 94026, pp. 85–90.

Leng, Goh Wee, "an Expert Autonomous Vacuum Cleaner Robot", School of Electrical & Electronic Engineering, Nanyang Technological Institue, Singapore, pp. 598–604 (1998).

Schofiled, Monica, "Cleaning Robots", Service Robot: An International Journal, vol. 1, No. 3, MCB University Press, pp. 11–16 (1995).

Ward, Charles W., "Sweeping Revelations From A First Time Robot–User", Commercial Services of Virginia, Inc., pp. 14–1 to 14–6.

Yaguchi, Hiroshi, "Robot Introduction To Cleaning Work In The East Japan Railway Company", Advanced Robotics, vol. 10, No. 4, VSP and Robotics Society of Japan, pp. 403–414 (1996).

FIG. 24

2200

```
HANDLES
  variables: enable-time, disable-time

if (NOT error) {                                          } 2202
  right-handle is ui-right-handle                         } 2204
  left-handle is ui-left-handle

  if (right-handle or left-handle) {                      }
    disable-time is FALSE                                 }
    time-disabled is FALSE                                } 2206
    if (NOT enable-time)                                  }
      enable-time = current time                          }
    time-enabled = current time - enable-time             }
  }
  else {
    enable-time is FALSE                                  }
    time-enabled is FALSE                                 } 2208
    if (NOT disable-time)                                 }
      disable-time = current time                         }
    time-disabled = current time - enable-time            }

  }
  enabled is (right-handle OR left-handle)                } 2210
}
else {
  enabled is FALSE                                        }
  right-handle is FALSE                                   }
  left-handle is FALSE                                    } 2212
  time-enabled is FALSE                                   }
  time-disabled is FALSE                                  }
}
```

2300

```
ERROR
**low level software filters the hopper full sensor**

  if (ui-hopper-missing OR ui-tank-overflow OR ui-tank-empty OR system-error)  } 2302
    error is TRUE
```

FIG. 22

2800

```
DISTANCE
variable : burnish distance, squeegee distance

if (scrub-cmd AND scrubbing) {                                  } 2802
  if (NOT burnish-distance)
    burnish-distance = 0
  else
    burnish-distance = burnish-distance +
      DistanceFunction (right-drive-speed, left-drive-speed, rate)  } 2804
}
else
  burnish-distance = FALSE

if (scrubbing)
  squeegee-distance = FALSE                                     } 2806
  squeegee-time = FALSE
else
  if (NOT squeegee-distance)                                    } 2808
    squeegee-distance = 0
    squeegee-time = current-time + squeegee-timeout             } 2810
  else
    squeegee-distance = squeegee-distance +                     } 2812
      DistanceFunction (right-drive-speed, left-drive-speed, rate)

if (squeegee-time) {                                            } 2814
  if ( (squeegee-distance > safe-distance-to-squeegee) OR       } 2816
      (current-time > squeegee-time))
    squeegee-safe is TRUE                                       } 2818
  else
    squeegee-safe is FALSE
}

if (burnish-distance > safe-distance-to-burnish)                } 2820
  burnish-safe is TRUE                                          } 2822
else
```

FIG. 29

```
CONTROL
** sweep, scrub, and burnish buttons polled at low level **

sweep-cmd is ui-sweep-cmd
scrub-cmd is ui-scrub-cmd
burnish-cmd is ui-burnish-cmd
speed = ui-speed
```

FIG. 23

2400

```
ENABLE
drive-enabled is (enabled AND (NOT(sweep-cmd XOR sweeping)) AND  (NOT (scrub-cmd  } 2402
XOR scrubbing)))
```

FIG. 25

```
DRIVE
** run at speed-ramp-rate times per second **
{
 if (right-wheel-target-speed is NOT right-wheel-current-speed)
   right-wheel-current-speed = right-wheel-current-speed + minimum of:
                                        speed-ramp-step
                                        (right-wheel-target-speed - right-
wheel-current-speed)
 if (left-wheel-target-speed is NOT left-wheel-current-speed)
   left-wheel-current-speed = left-wheel-current-speed + minimum of :
                                        speed-ramp-step
                                        (left-wheel-target-speed - left-
wheel-current-speed)
 right-drive-speed = right-wheel-current-speed
 left-drive-speed = left-wheel-current-speed
}                                                                  } 2702

if (drive-enabled AND (NOT error) ) {                              } 2704
 if (left-handle)                                                  } 2706
   right-wheel-target-speed = ConvertSpeedFunction (speed)         } 2708
 else
   right-wheel-target-speed = speed=wheel-stop
 if (right-handle)                                                 } 2710
   left-wheel-target-speed = ConvertSpeedFunction (speed)
 else                                                              } 2712
   left-wheel-target-speed = speed-wheel-stop

 if (right-handle OR left-handle)                                  } 2714
   if (NOT driving)
     driving is TRUE
 else                                                              } 2716
   if (driving)
     driving is FALSE
}
else (
 right-wheel-target-speed = speed-wheel-stop
 left-wheel-target-speed = speed-wheel-stop                        } 2718
 if (driving)
   driving is FALSE
}
```

FIG. 28

SWEEP

```
if (sweep-cmd AND (speed is NOT reverse) AND (NOT error) ) (        } 2502
  if (time-enabled > delay-on-sweep-start)
    if (sweeper is off)
      turn sweeper on
  if (time-enabled > delay-on-sweep-lower)                          } 2504
    if (sweeper is up)
      sweeper to down
    else
      if (NOT sweeping)                                             } 2506
      sweeping is TRUE
  if (time-disabled > delay-off-sweep-raise)
    if (sweeper is down)
      raise sweeper                                                 } 2508
      if (sweeping)
      sweeping is FALSE
  if (time-disabled > delay-off-sweep-stop)
    if (sweeper is on)                                              } 2510
      turn sweeper off
}
else {
  if (sweeper is down)
    sweeper to up
    if (sweeping)                                                   } 2512
      sweeping is FALSE
  if (sweeper is on)
    turn sweeper off
}
```

FIG. 26

```
if (scrub-cmd AND (speed is NOT reverse) AND (NOT error) ) (        } 2602
 if (time-enabled > delay-on-scrub-start) (
  if (shroud is closed)
   open shroud
  if (scrubber is off)
   turn scrubber on
  if (vacuum is off)                                                } 2604
   turn vacuum on
  if (squeegee is up)
   lower squeegee
  if (solenoid is closed)
   open solenoid
 }
 if (time-enabled > delay-on-scrubber-lower) {
  if (pump is off)
   turn pump on
  if (scrubber is up)                                               } 2606
   lower scrubber
  else
   if (NOT scrubbing)
   scrubbing is TRUE
 }
 if (time-disabled > delay-off-scrubber-raise) (
  if (scrubber is down)
   raise scrubber                                                   } 2608
   if (scrubbing)
   scrubbing is FALSE
  if (pump is on)
   turn pump off
 }
 if (time-disabled > delay-off-scrubber-stop) (
  if (scrubber is on)
   turn scrubber off                                                } 2610
  if (solenoid is open)
   close solenoid
  if (squeegee-safe) (
   if (shroud is open)
   close shroud
   if (squeegee is down)
   raise squeegee                                                   } 2612
   if (vacuum is on)
   turn vacuum off
  }
 }
}
```

FIG. 27

```
else(
  if (scrubber is down)
    raise scrubber
    if (scrubbing)
      scrubbing = FALSE
  if (pump is on)                                  } 2614
    turn pump off
  if (scrubber is on)
    turn scrubber off
  if (solenoid is open)
    close solenoid
if ( (speed is reverse) OR error) (
  if (shroud is open)
    close shroud
  if (squeegee is down)                            } 2616
    raise squeegee
  if (vacuum is on)
    turn vacuum off
)
else if (squeegee-safe) (
  if (shroud is open)
    close shroud
  if (squeegee is down)                            } 2618
    raise squeegee
  if (vacuum is on)
    turn vacuum off
```

FIG. 27A

BURNISH

```
if (burnish-cmd AND (speed is NOT reverse) AND (NOT error) ) (          }2902
 if (time-enabled > delay-on-burnisher-start) (
  if (burnisher off)                                                    } 2904
   turn burnisher on
  if (burnish-safe AND driving) (
   if (burnisher NOT down)
   burnisher to down
   else                                                                 } 2906
   if (NOT burnishing)
    burnishing is TRUE
  {
  else
   if (burnisher NOT at middle)                                         } 2908
    burnisher to middle
 }
 if ( (time-disabled > delay-off-burnish-stop) OR (NOT driving) ) (
  if (burnisher is down)
   burnisher to middle
   if (burnishing)                                                      } 2910
   burnishing is FALSE
  if (burnisher is on)
   turn burnisher off
 }
 if (time-disabled > delay-off-burnish-raise)                           } 2912
  if (burnisher NOT up)
   burnisher to up
}
else{
 if (burnisher is down)
  burnisher to up                                                       } 2914
  if (burnishing)
   burnishing is FALSE
 if (burnisher is on)
  turn burnisher off
}
```

FIG. 30

FLOOR CLEANING APPARATUS WITH CONTROL CIRCUITRY

RELATED APPLICATIONS

This application is a continuation application of U.S. Ser. No. 10/619,150 filed Jul. 14, 2003, which is a divisional application of U.S. Ser. No. 09/588,414 filed Jun. 6, 2002 now ABN, which claims priority of U.S. Provisional Application Ser. No. 60/138,179 filed Jun. 8, 1999.

FIELD OF THE INVENTION

This invention relates to floor cleaning systems or cleaners for cleaning floors such as waxed floor surfaces including Vinyl Composition Tile (VCT) floors with a glossy polymeric finish such as an Ultra High Speed (UJHS) commercial finish.

BACKGROUND OF THE INVENTION

Modem resilient and hard flooring materials are often coated with polymer coatings which may be natural or synthetic polymers, sometimes referred to as "floor waxes". These coating materials can impart various types of finish to the floors. Acrylic polymers are often used on such floors where a transparent, glossy finish is desired. Following application of the coating materials, the floor must be periodically swept, scrubbed and polished to restore the shine worn by foot and other traffic on the floor. For glossy floors, the burnishing and other operations may be performed daily.

Cleaning of polymer coated resilient and hard floor materials has traditionally comprised the operations of sweeping, scrubbing and burnishing. These operations are generally performed separately in the recited order. The coated floor is initially swept or dust mopped to remove dust and larger debris particles so that they will not be acted upon by the scrubbing and/or burnishing steps that follow and cause discoloration or damage to the floor coating. After sweeping, the floor is cleaned by scrubbing with water and other additives such as soaps, surfactants and the like and left to dry under ambient conditions, with or without bulk liquid being first removed by a squeegee operation separate from, or in conjunction with, the scrubbing operation. After scrubbing, the dry floor coating may be burnished with a burnishing device to provide a luster or shine to the coating surface which is an appearance often desired in commercial buildings. The burnisher is typically a propane powered device which rotates a flat, circular polishing pad at relatively high speed to polish the floor coating.

The above operations have generally been performed manually in three separate steps. More recently, mechanical, powered sweepers, scrubbers and burnishers have become available. Often a single operator will perform the operations serially.

SUMMARY OF THE INVENTION

The present inventors have discovered that performing the burnishing operation with one or more of the sweeping and/or scrubbing operations is advantageous. Combining the scrubbing and burnishing operations, in a unitary, coordinated method or system so that the operations are performed serially, but closely spaced in time, is particularly desirable and provides certain advantages not previously achieved or recognized.

In addition, a preferred embodiment of the present invention includes at least scrubbing and burnishing, and most preferably all three operations, in a single unitary device with logical electronic and mechanical controls that allow a sin-le operator to easily manipulate all of activities of the floor cleaning operations simultaneously. This permits all three traditional operations to be performed with a single pass of the floor cleaning device over a given floor area. Advantages include the saving of labor and time as well as ensuring that the burnishing operation will never be performed on an unclean floor which could result in forcing the soil into the surface causing discoloration or severe damage to the coating surface. More surprisingly, the present system provides enhanced performance compared to the conventional operations performed serially at widely spaced intervals using separate devices. More particularly, the burnishing operation provides enhanced results, such as increased gloss, when performed closely following the scrubbing operation.

In a presently preferred embodiment of the invention, the system comprises a mechanical structure wherein each of the selected cleaning operations is included in a single device having a unitary structure for operation by a single operator. Alternatively, the system may be a "train" of devices coordinated mechanically or electronically by a single operator. An important feature is that the scrubbing and burnishing operations be performed in the desired order and in close proximity in time while the coating is in a deformable, plastic state.

As used in this application, the term "coating" or "wax" refers to widely used polymeric coating materials which are applied to a relatively smooth natural or synthetic resilient or hard flooring material, such as vinyl tile or natural stone or other synthetic, hard or resilient materials. Typically these coatings comprise one or more natural and/or synthetic polymers, such as the hard Carnauba waxes, or a mixture of materials containing a synthetic polymer such as an acrylic polymer. The coating should be solid at room temperature and transparent and hard enough to provide protection for the underlying flooring and stand up to pedestrian traffic. Because these coatings can be damaged or marked during use, such surfaces are typically maintained by periodic sweeping, wet scrubbing and/or burnishing. The acrylic polymer coatings are preferred for floors that are maintained in a high gloss state.

As used in this application, the term "sweeping" refers to a dry operation involving removing dust and larger particles from a floor surface such as by dust mopping, brushing, vacuuming or blowing or the like so that loose soil particles and other materials are not present during the scrubbing or burnishing operations where their presence could inhibit the cleaning or burnishing or cause a discoloration of the coating or other physical damage to the floor surface during the more aggressive scrubbing and burnishing operations.

The term "scrubbing" as used with respect to this invention refers to a wet operation involving the application of water and/or other common cleaning compositions to a coated floor surface together with scrubbing the floor surface with mops, rotating pads or brushes or other cleaning tools. In the present invention it has been discovered that a cylindrical brush having relatively soft, synthetic polymeric bristles is preferred which may be rotated at speeds of from about 500 to 2000 rpm. The scrubbing operation may also involve removal of bulk surface liquid from the floor following scrubbing, such as by evaporation, vacuuming or a mechanical squeegee operation or a combination thereof.

The term "burnishing" as used herein means the relatively high-speed polishing of the coating surface of the floor after scrubbing to provide a glossy, reflective surface. Modem burnishing tools generally comprise an electric or gas or liquid fuel powered machine for rotating a flat, circular fibrous pad at relatively high speed (for example 1000 to 4000 rpm) to polish the surface.

The "gloss" of the coating is measured by a gloss meter which directs a beam of light normal to the surface of the floor and measures the reflection of the light at angles of 20 degrees and/or 60 degrees from normal. The percentage of the light reflected is reported as the "gloss" of the floor coating. A difference of 5 points on the gloss meter represents a difference which can be perceived as significant by the human eye.

In one general aspect, the invention features a floor cleaner for cleaning a floor, where the floor cleaner has a front and a rear and includes: an optional sweeper for sweeping the floor; a scrubber, connected to the sweeper and located in the rear of the sweeper, for wetting and cleaning the floor; and a burnisher, connected to the scrubber and located in the rear of the scrubber, for burnishing the floor.

Embodiments of this aspect of the invention may include one or more of the following features.

The cleaner is sized to operate within aisles having dimensions greater than or equal to about 24 inches.

The sweeper includes two counter-rotating brushes, one or both of which is driven by a motor. The brushes are positioned relative to one another such that bristles of the brushes overlap. The sweeper includes a hopper spaced from the brushes, and a ramp which is connected to the hopper and located between the brushes and the hopper. A portion of the ramp is located under a portion of the brushes. A portion of the ramp is curved upwardly along an axis extending from the brushes to the hopper. The brushes are mounted on the frame for retraction substantially along a vertical axis.

The scrubber includes a scrubber brush which has an axis of rotation substantially parallel to the floor and substantially perpendicular to an axis running from the front to the rear of the cleaner. The scrubber brush includes 0.15 mm diameter polymeric bristles. The scrubber is pivotally mounted on the frame for retraction.

A cleaning liquid dispenser dispenses cleaning liquid. The cleaning liquid dispenser includes a liquid dispensing trough positioned substantially parallel to the axis of rotation of the scrubber brush and is substantially coextensive with the scrubber brush. The liquid dispensing trough has at least one opening for dispensing a cleaning liquid.

The scrubber includes a member which is mounted for movement from a first position to a second position. In its first position, the member prevents cleaning liquid from the scrubber brush to fall on the floor. In its second position, the member prevents the cleaning liquid from the scrubber brush to splash against at least a portion of the cleaner. The member extends along the length of the scrubber brush and is rotatable between the first and second positions around a second axis substantially parallel to the axis of rotation of the scrubber brush.

A squeegee blade is positioned in the rear of the scrubber brush along a second axis parallel to the axis of rotation of the scrubber brush. A vacuum source applies suction to a portion of the floor in front of the squeegee blade to collect liquid gathered by the squeegee blade. A second squeegee blade is positioned in front of, and spaced apart from, the first-mentioned squeegee blade. The vacuum source applies the suction to the space between the first-mentioned and the second squeegee blades.

A cleaning liquid system includes the vacuum source, the cleaning liquid dispenser, a chamber for separating the cleaning liquid from a mixture of air and cleaning liquid collected by the suction applied to the floor by the vacuum source, and a filter for filtering out dirt from the separated cleaning liquid prior to dispensing the separated cleaning liquid by the cleaning liquid dispenser. The chamber is shaped and sized to reduce a velocity of a flow of the mixture of air and cleaning liquid to separate the cleaning liquid from the mixture of air and cleaning liquid. A squeegee mount houses one or both of the squeegee blades, where the squeegee mount includes grooves for slidably mounting the squeegee blades. The grooves are typically key-hole shaped, and portions of the squeegee blades may be key-shaped and sized to fit in the grooves. The squeegee mount defines a cavity between the first and second grooves, at one end the cavity opening to the space between the squeegee blades and at another end connecting to a vacuum source. The squeegee mount is pivotally mounted on the frame for vertical retraction.

The burnisher and scrubber are positioned relative to one another such that a front-most point of a burnisher pad of the burnisher is located between 10 cm and 40 cm from a rear-most point of contact of the scrubber brush to the floor. The burnisher pad includes a burnishing pad and a motor for spinning the burnisher pad. The burnisher is mounted on the frame for vertical retraction substantially along a vertical axis. The burnisher is mounted on the frame by a four bar linkage which floatingly supports the burnisher pad near the floor during operation.

The cleaner has a drive wheel, and a motor which is disengagably coupled to the drive wheel and drives the drive wheel. A control circuitry controls a velocity of the drive wheel by measuring the velocity, comparing the measured velocity to a selected velocity, and adjusting the velocity of the drive wheel based on a result of the comparison.

In another general aspect, the invention features a floor cleaner for cleaning a floor which includes: a scrubber for wetting and cleaning the floor; and a member being mounted for movement from a first position to a second position, where in the first position the member prevents cleaning liquid from the scrubber brush to fall on the floor and in the second position the member prevents the cleaning liquid from the scrubber brush to splash against at least a portion of the cleaner.

In yet another general aspect, the invention features a cleaner which includes a scrubber for wetting and cleaning the floor, a squeegee blade, and a squeegee mount for housing the squeegee blade, where the squeegee mount includes a groove for slidably mounting the squeegee blade.

In yet another general aspect, the invention features a cleaner for cleaning a floor, where the cleaner includes: a first assembly of components for performing a first cleaning operation on the floor; a second assembly of components for performing a second cleaning operation on the floor; and control circuitry, connected to the first and second assemblies, executing in parallel a first program module operating the first assembly and a second program module operating the second assembly.

Embodiments of this aspect of the invention may include one or more of the features below.

The first program supplies data to the second program, and the second program modifies the operation of the second assembly based on the data.

The control circuitry comprises at least two processors, one processor executing the first program and the second processor executing the second program.

The first assembly includes a scrubber and the second assembly includes a sweeper.

The cleaner includes a third assembly of components for burnishing the floor, where the control circuitry is further connected to the third assembly and executes, in parallel with the first and second program modules, a third program module operating the third assembly.

In one other general aspect, the invention features a cleaner for cleaning a floor, where the cleaner includes: a first assembly of components for performing a first cleaning operation on the floor, a second assembly of components for performing a second cleaning operation on the floor; control circuitry, connected to the first and second assemblies, executing in parallel a first and second program modules; where the first program module includes a first plurality of instructions for controlling the operations of the first and second assemblies and coordinating among the operations of the first and second assemblies and the second computer program module includes a second plurality of instructions for controlling the operations of the first and second assemblies; where the first plurality of instructions includes an instruction for supplying a command from the first program module to the second program module, the command requiring performance of a sequence of actions by at least one of the first and second assemblies, where the first program module, after executing the instruction for supplying the command, executes other instructions independent of performance of the sequence of actions; and where the second plurality of instructions includes a sequence of instructions for causing the at least one of the first and second assemblies to perform the sequence of actions, the second program module executing the sequence of instructions independent of the first program module.

Embodiments of this aspect of the invention may include one or more of the following features.

The control circuitry has at least two processors, one processor executing the first program module and the second processor executing the second program module. The first assembly includes a scrubber and the second assembly includes a sweeper.

The cleaner has a third assembly of components for burnishing the floor, where the control circuitry is further connected to the third assembly. The first program module further includes a third plurality of instructions for operating the third assembly and coordinating among the operations of the third assembly, and the first and second assemblies. The second computer program module includes a fourth plurality of instructions for operating the third assembly. The second plurality of instructions includes an instruction for supplying a second command from the first program module to the second program module, the command requiring performance of a second sequence of actions by the third assembly, where the first program module, after executing the instruction for supplying the second command, executes other instructions independent of performance of the second sequence of actions. The second plurality of instructions includes a second sequence of instructions for causing the third assembly to perform the second sequence of actions, the second program module executing the second sequence of instructions independent of the first computer program module.

In another general aspect, the invention features a cleaner which includes: a first assembly of components for performing a first cleaning operation; a second assembly of components for performing a second cleaning operation; and control circuitry, connected to the first and second assemblies, coordinating an operation of the first assembly relative to an operation of the second assembly based on a distance traveled by the cleaner.

Aspects of the invention may be implemented in hardware or software, or a combination of both. Preferably, these aspects are implemented in computer programs executing on programmable computers that each include a processor, a storage medium readable by the processor (including volatile and non-volatile memory and/or storage elements). Program code is applied to data entered through the input device to perform the functions described above and to generate output information. The output information is applied to one or more output devices.

Each program is preferably implemented in a high level procedural or object oriented programming language to communicate with a computer system. However, the programs can be implemented in assembly or machine language, if desired. In any case, the language may be a compiled or interpreted language.

Each such computer program is preferably stored on a storage medium or device (e.g., ROM or magnetic diskette) that is readable by a general or special purpose programmable computer for configuring and operating the computer when the storage medium or device is read by the computer to perform the procedures described in this document. The system may also be considered to be implemented as a computer-readable storage medium, configured with a computer program, where the storage medium so configured causes a computer to operate in a specific and predefined manner.

Other features and advantages of the invention will become apparent from the following description of preferred embodiments, including the drawings, and from the claims.

BRIEF DESCRIPTION OF THE DRAWINGS

FIG. 22 is the pseudocode for the steps taken by an error behavior module of the application program;

FIG. 23 is the pseudocode for the steps taken by a control behavior module of the application program;

FIG. 24 is the pseudocode for the steps taken by a handle behavior module of the application program;

FIG. 25 is the pseudocode for the steps taken by an enable behavior module of the application program;

FIG. 26 is the pseudocode for the steps taken by a sweep behavior module of the application program;

FIG. 27 is the pseudocode for the steps taken by a scrub behavior module of the application program;

FIG. 28 is the pseudocode for the steps taken by a drive behavior module of the application program;

FIG. 29 is the pseudocode for the steps taken by a distance behavior module of the application program; and FIG. 30 is the pseudocode for the steps taken by a burnish behavior module of the application program.

DESCRIPTION OF THE PREFERRED EMBODIMENTS

Figure 1:
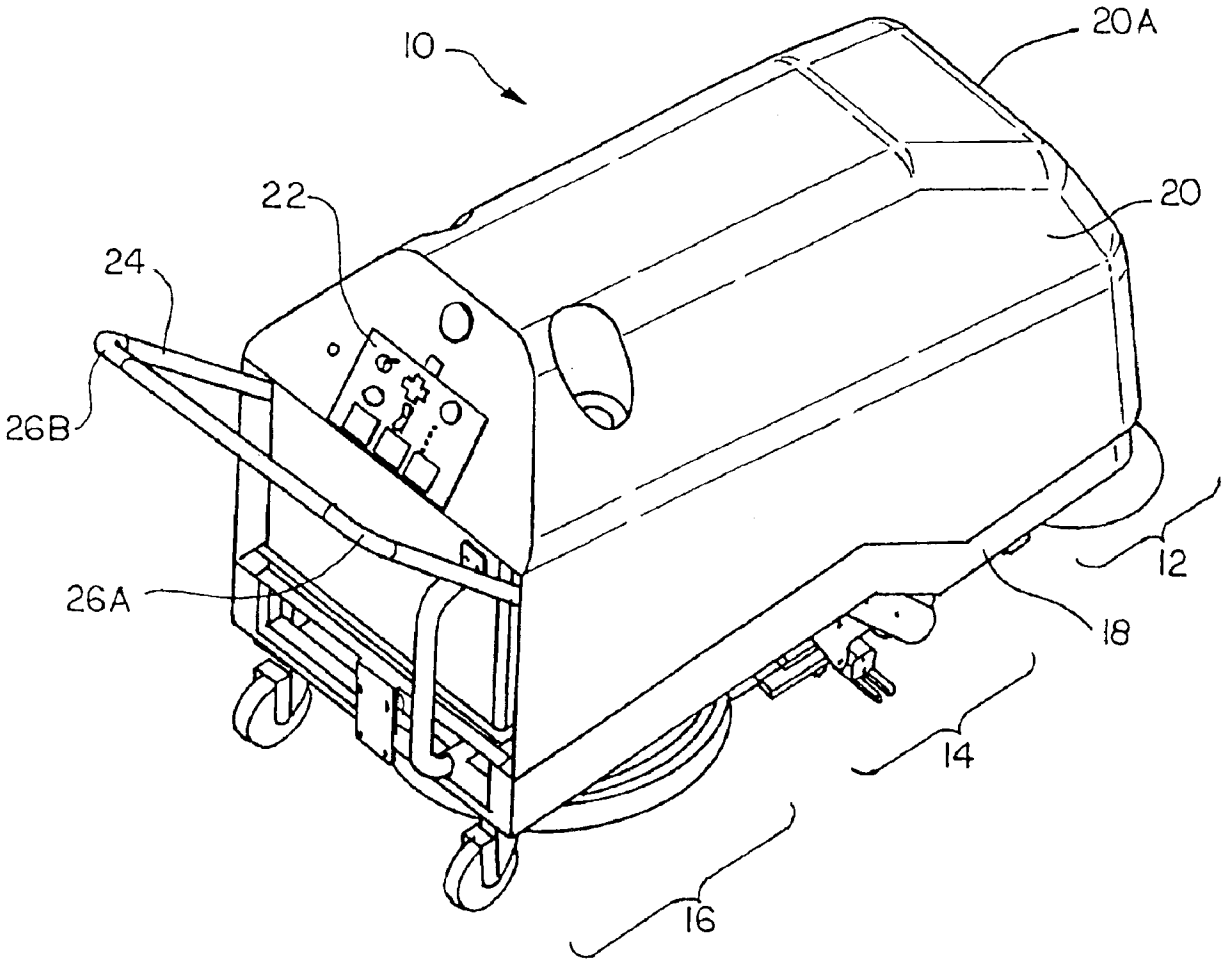
FIG. 1 is a top, rear perspective view of a cleaner.

Referring to FIGS. 1, 2, 3, and 3A, a cleaner 10 typically includes a sweeper assembly 12, a scrubber assembly 14, and a burnisher assembly 16, each of which is mounted on a common frame 18. In one embodiment, cleaner 10 may only include scrubber assembly 14 and burnisher assembly 16. Cleaner 10 also includes a housing 20 which is fastened to frame 18. Housing 20 has a front end 20A and a rear end 20B. Cleaner 10 is preferably sized to fit in aisles of typical retail stores such as grocery stores and department stores. Such aisles typically have widths greater than or equal to about 24 inches, and more typically ranging from about 39 to about 72 inches.

Cleaner 10 further includes a vacuum and cleaning liquid subsystem 30 to which scrubber assembly 14 is connected. Vacuum and liquid subsystem 30 is responsible for depositing a cleaning liquid on a scrubber brush of scrubber assembly 10 and recovering the deposited liquid from the floor. Cleaner 10 also includes batteries 32 which supply power to the various circuits and motors in cleaner 10, including two motors 64 driving a right drive wheel 28B and a left drive wheel 28A (not shown) for moving cleaner 10 in various directions. Batteries 32 are contained within battery storage 32A. Multiple batteries are supplied as battery pack 32B which are held together by battery support 32C.

Housing 20 has a control panel 22 which can be used by a user to operate cleaner 10. The controls on control panel 22 provide the user with the option of choosing to sweep, scrub, burnish, or perform any combination of these three cleaning operations including performing all three cleaning operations at once. The controls on the control panel 22 also include an emergency stop button which the user can use to stop all cleaning operations and movements of cleaner 10 in the case of an emergency. The controls further include a speed and direction selector which allows the user to select among two forward speeds and one reverse speed. The controls further include a key switch for turning cleaner 10 on and off. A series of LEDs on control panel 22 indicate to the user which cleaning functions are being currently performed.

Cleaner 10 also includes a handle 24 having right and left pressure sensing pads 26A–B. The user can use these pads to control the direction of travel of cleaner 10 by directly controlling the speed of rotation of drive wheels 28A–B. The user can make cleaner 10 turn right by selectively applying pressure to right pressure sensing pad 26A rather than to left pressure sensing pad 26B. Similarly, the user can make cleaner 10 turn left by applying pressure to left pressure sensing pad 26B rather than to right pressure sensing pad 26A. By pressing both pressure sensing pads 26A–B, the user can make cleaner 10 travel forward in a straight line. The user can stop cleaner 10 by removing both hands from pressure sensing pads 26A–B for a predetermined period of time.

Pressure sensing pads 26A–B and the controls on the control panel 22 supply control signals to a control subsystem 34 (schematically shown in FIG. 20) which, in accordance with those signals, operate cleaner 10. Control subsystem 34, among other things, includes software for automatically controlling the various cleaning operations of cleaner 10. The application programs are designed to improve the quality of cleaning operations and reduce the risk of damage to the floor by ensuring that cleaning operations are performed in particular sequences. For example, when the user selects performing all three cleaning operations at the same time, the application programs ensure that the burnisher assembly 16 does not burnish a floor surface which has not already been scrubbed by scrubber assembly 14. Additionally, when the user selects to stop all cleaning operations, the application programs ensure that as much as possible the deposited cleaning liquid is collected from the floor surface prior to stopping all cleaning operations.

Having briefly described the structure and operation of cleaner 10, we will now describe in detail the structure and operation of each of the subsystems of cleaner 10. These subsystems are, in the order they will be described: drive wheels 28A–B, sweeper assembly 12, scrubber assembly 14, burnisher assembly 16, vacuum and cleaning liquid subsystem 30, and control subsystem 34.

Drive Wheels

Figure 2:
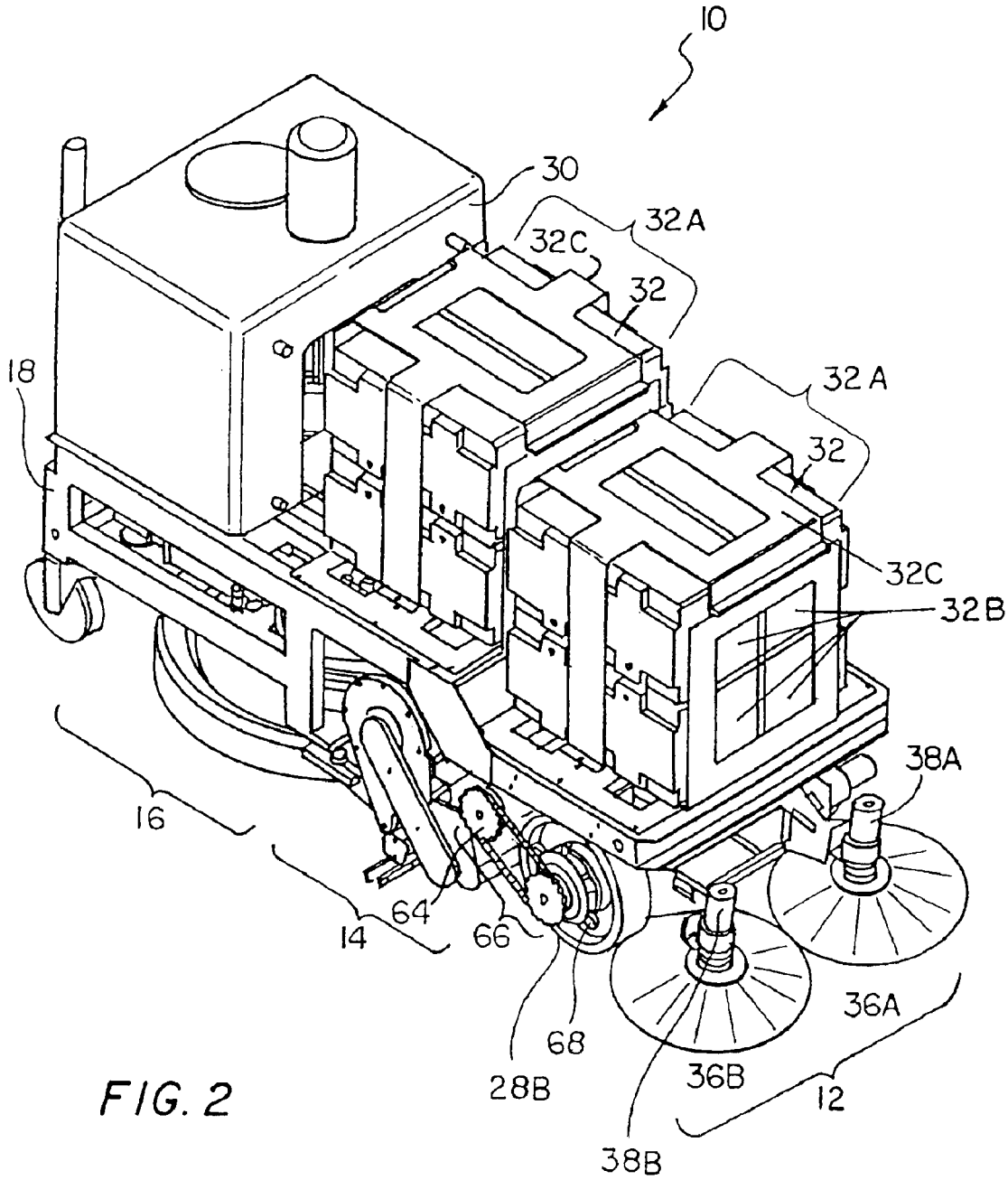
FIG. 2 is a top, front perspective view of the cleaner with its housing removed.

Referring specifically to FIG. 2, each one of drive wheels 28A–B is driven by a dedicated DC servo motor 64 through gear and chain mechanism 66 (only the mechanism for drive wheel 28A is shown). Each one of servo motors 64 is controlled by control system 34. Each one of drive wheels 28A–B can be disengaged from its motor 64 by turning a knob 68 on that drive wheel. Drive wheels 28A–B may also be located between burnisher assembly 16 and scrubber assembly 14, especially when sweeper assembly 12 is absent to provide a pivot point for cleaner 10 making it easier for the operator to handle and to negotiate sharp turns.

Sweeper Assembly

Figure 4:
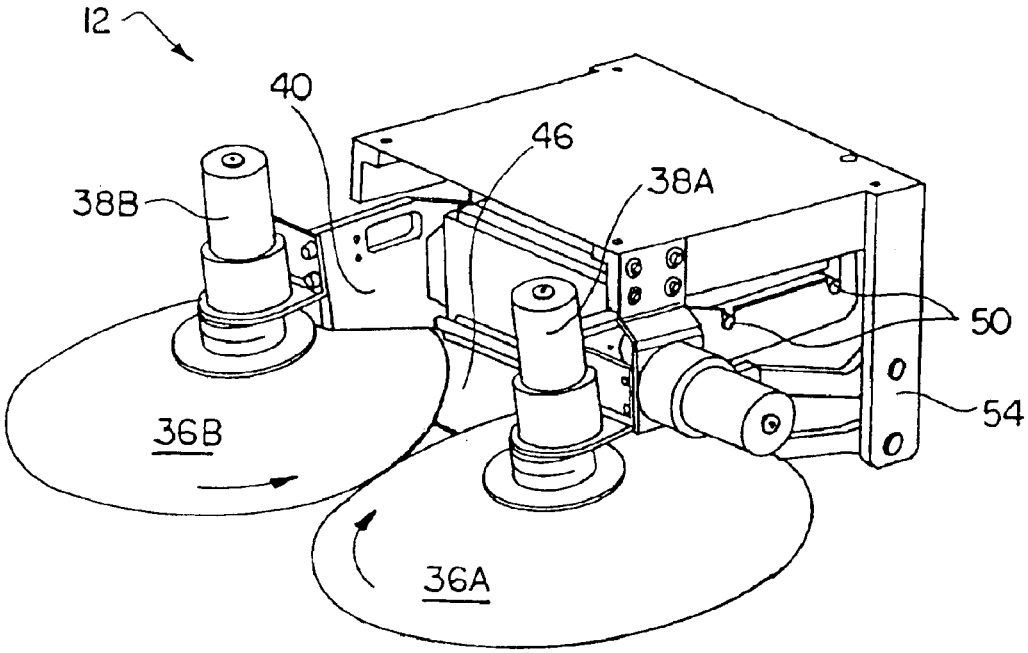
FIG. 4 is a perspective view of the sweeper assembly of the cleaner.
Figure 4A:
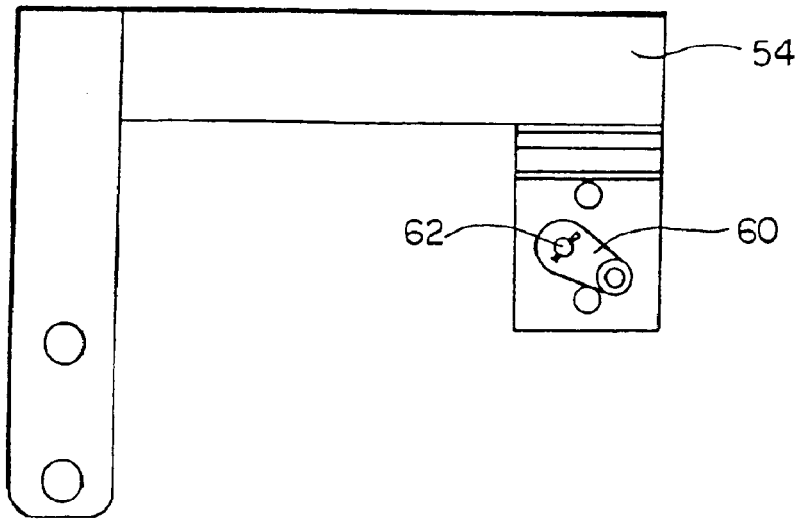
FIG. 4A is a cross-section view of a portion of the sweeper assembly.
Figure 5:
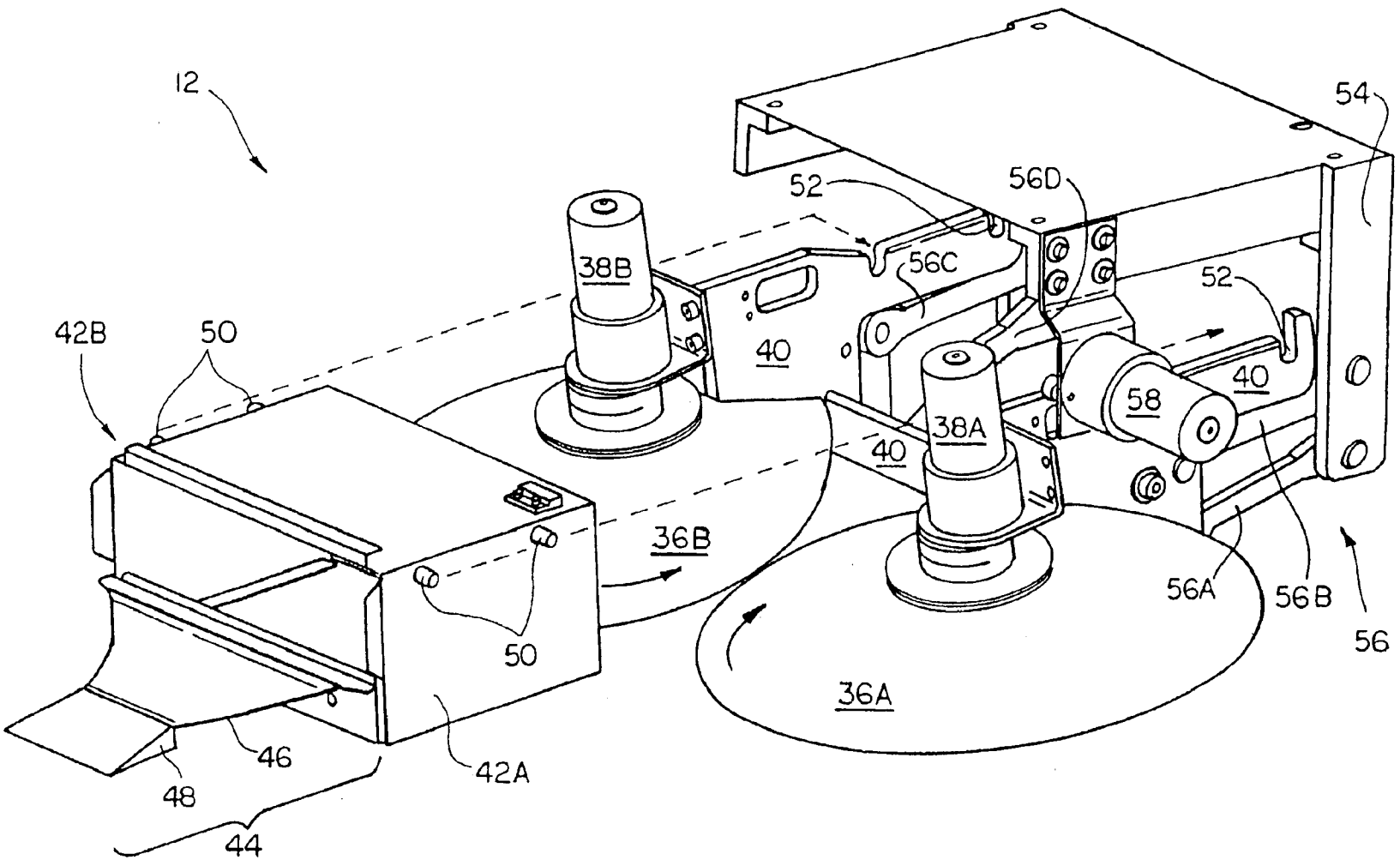
FIG. 5 is another perspective view of the sweeper assembly with its hopper removed.
Figure 6:
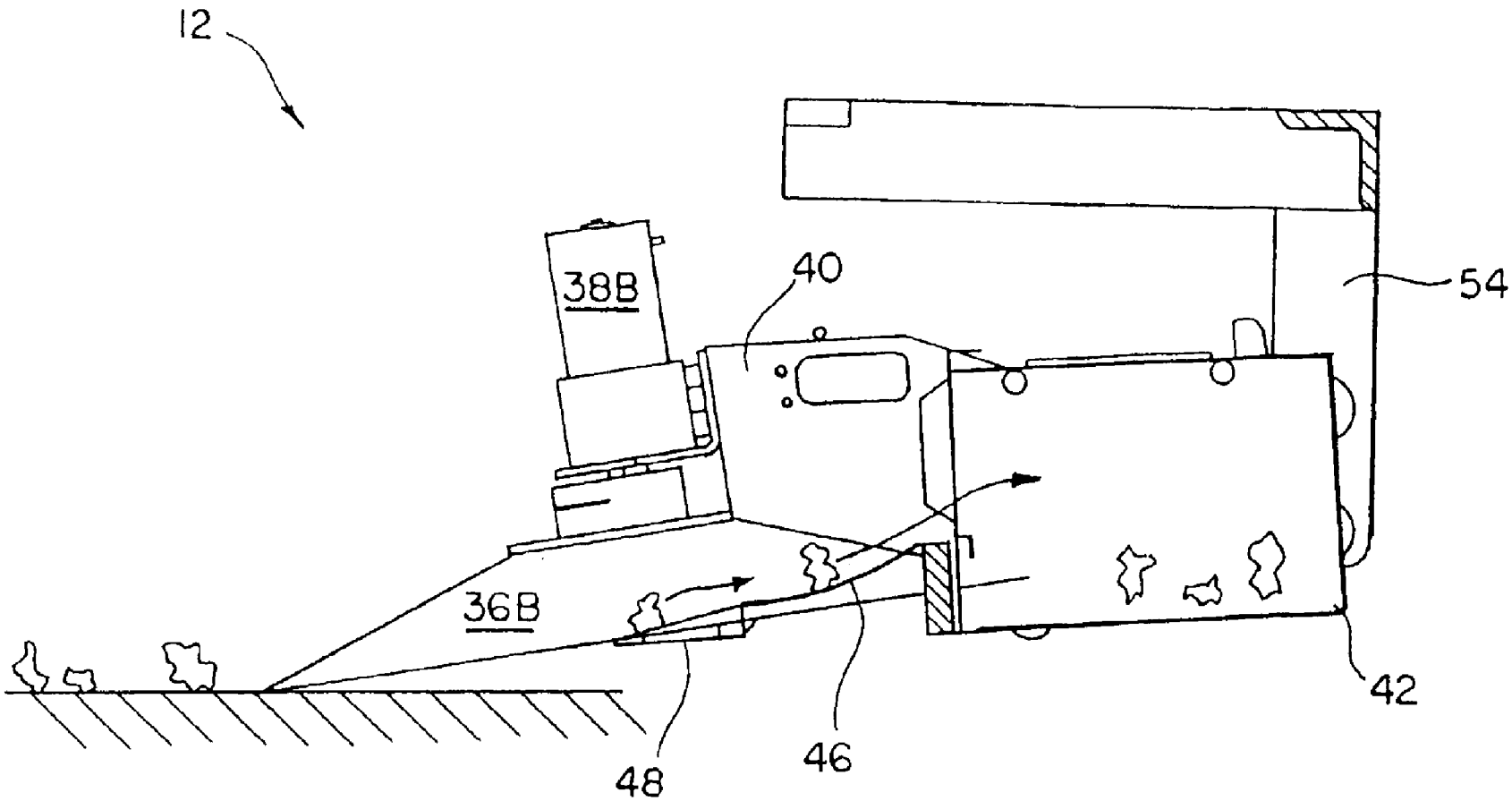
FIG. 6 is a cross-sectional view of the sweeper assembly.

Referring to FIGS. 4, 4A, 5, and 6, sweeper assembly 12 includes two counter-rotating brushes 36A–B, each of which is respectively driven by one of DC servo motors 38A–B. Motors 38A–B are connected to a DC servo motor driver in control subsystem 34, which will be described in further detail below. Brushes 36A–B and motors 38A–B are mounted on a sweeper frame 40. Brushes 36A–B are located relative to one another such that their bristles overlap by approximately 0.5 inch. Sweeper assembly 12 also includes a hopper 42 and a ramp 44 connected to hopper 42. Ramp 44 has a solid metal portion 46 and a pliable, plastic portion 48. Solid portion 46 has a curved profile as shown in FIG. 6. Since plastic portion 48 is pliable, when plastic portion 48 comes into contact with the floor surface, it will less likely scratch or otherwise damage the floor surface.

Hopper 42 has four pegs 50 on an upper portion of its side walls 42A–B. To mount hopper 42 onto sweeper frame 40, hopper 42 is slid in between motors 38A–B and into an opening defined by sweeper frame 40 until each one of pegs 50 is aligned with a corresponding one of detentes 52. Hopper 42 is then lowered until each one of pegs 50 rests in the corresponding one of detentes 52 (best shown in FIG. 5). To remove hopper 42, hopper 42 is lifted up until pegs 50 are clear of detentes 52. Hopper 42 is then slid out of sweeper frame 40. Hence, hopper 42 can be easily removed to be emptied, and then can be easily placed back in sweeper frame 40.

Sweeper assembly 12 includes a mounting frame 54 for mounting the sweeper assembly onto frame 18 of cleaner 10 (shown in FIGS. 1–2). Mounting frame 54 is connected to sweeper frame 40 by a four bar linkage 56. Four bar linkage 56 has four horizontal members 56A–D, each one of which is pivotally connected at one end to mounting frame 54 and at another end to sweeper frame 40. Four bar linkage 54 allows sweeper frame 40 and components attached to sweeper frame 40 to be retracted and lowered substantially along a vertical axis.

Figure 3:
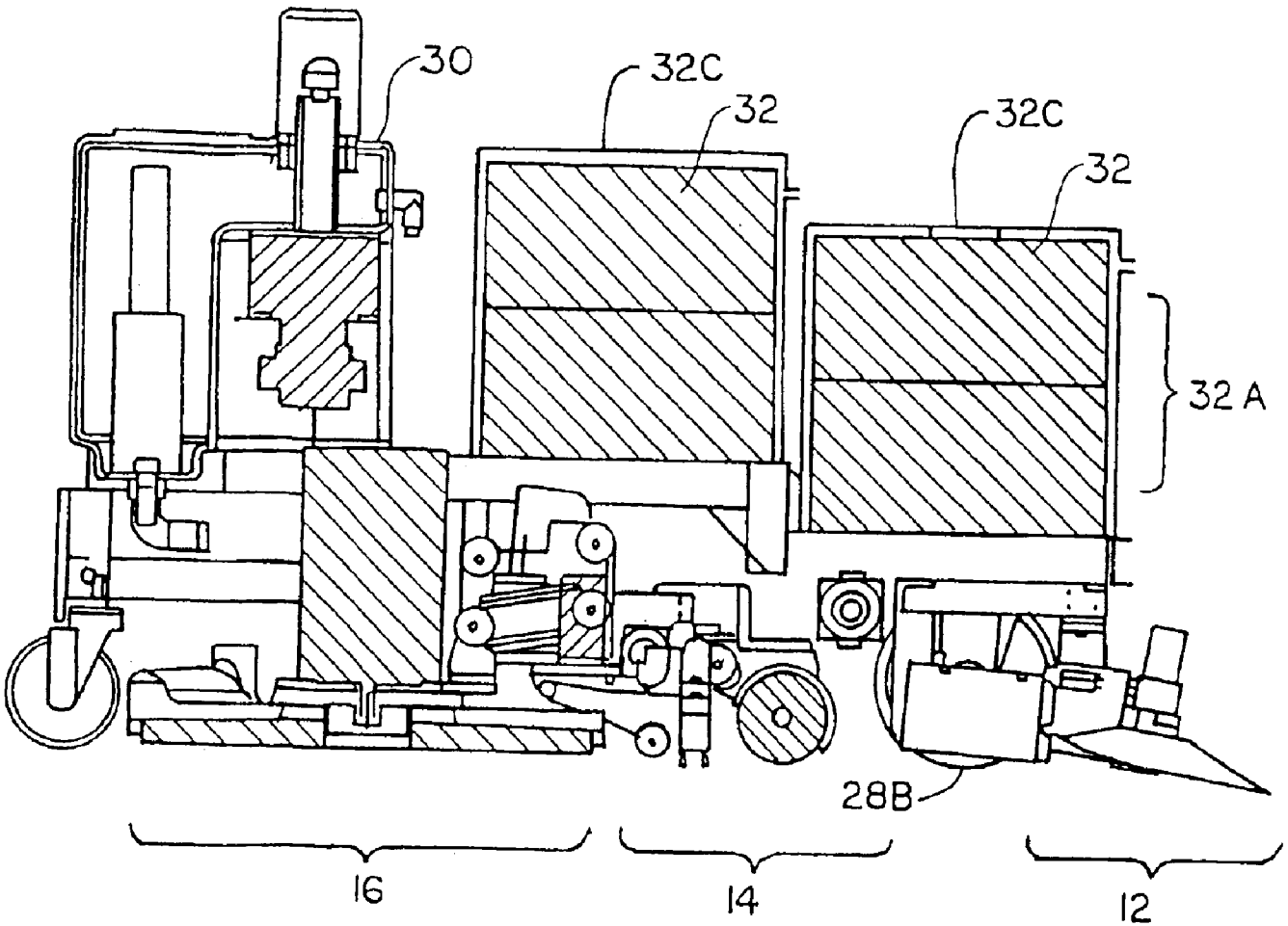
FIG. 3 is a cross-sectional view of the cleaner with its sweeper, scrubber, and burnisher assemblies in lowered positions.
Figure 3A:
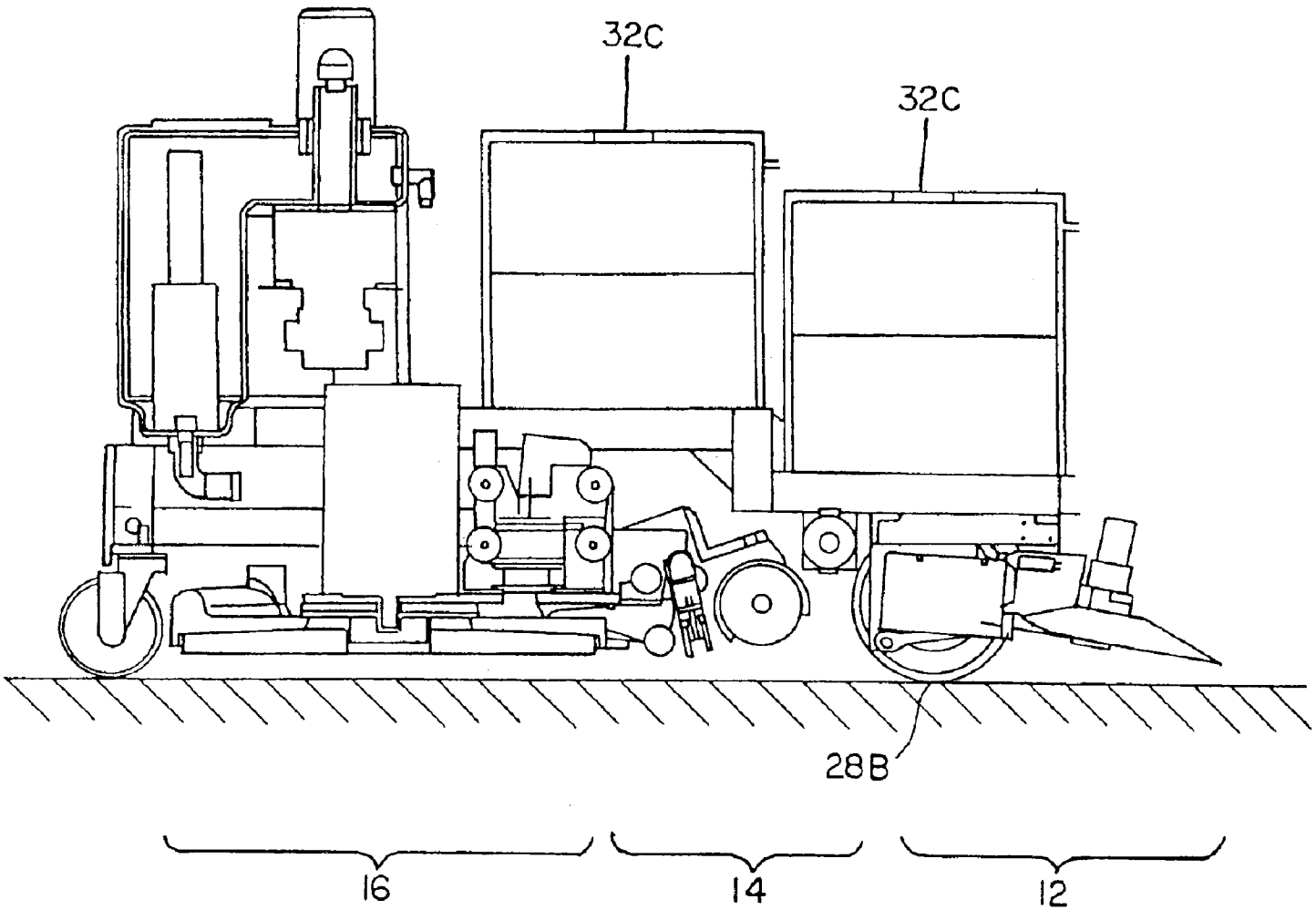
FIG. 3A is a cross-sectional view of the cleaner with its sweeper, scrubber and burnisher assemblies in retracted positions.

The mechanism for retracting and lowering sweeper frame 40 includes a DC servo motor 58 coupled to an off-center cam 60 which is rotatably coupled to a peg 62 of sweeper frame 40 (best shown in FIG. 4A). Motor 58 is connected to a DC servo motor driver controlled by control subsystem 34, as will be described in further detail below. As motor 58 rotates cam 60, cam 60 either lifts or lowers peg 62 and thereby retracts or lowers sweeper frame 40. FIGS. 3–3A show sweeper assembly 12 in its lowered and retracted positions.

Referring particularly to FIG. 6, during operation, motors 38A–B cause brushes 36A–B to rotate at about 30 to 100 RPM. Sweeper assembly 40, together with brushes 36A–B and ramp 44, are then lowered until brushes 36A–B come into contact with the floor. Brushes 36A–B sweep the debris in front of the brushes towards where brushes 36A–B overlap one another over the middle of ramp 44. There, brushes 36A–B catch the debris between their bristles and push the debris up ramp 44. The debris travels over curved portion 46 where the debris gains an upward momentum causing the debris to be effectively thrown into hopper 42.

Scrubber Assembly

Referring to FIGS. 7–9, 9A, and 10, scrubber assembly 14 includes a scrubber brush 80 rotatably mounted in a scrubber frame 90. Scrubber brush 80 has a horizontal axis of rotation substantially parallel to the floor surface and substantially perpendicular to the direction of travel of cleaner 10 during operation. Because scrubber brush 80 has a horizontal axis of rotation, it occupies a relatively small space, thereby allowing cleaner 10 to have components for performing three cleaning operations, that is, sweeping, scrubbing, and burnishing. For example, scrubber brush 80 has bristles which are polymeric bristles, preferably, having a diameter of about 0.15 mm.

Scrubber frame 90 is constructed out of a number of segments, and is pivotally connected to a mounting frame 92 by bolts 94. Mounting frame 92 is in turn mounted onto frame 18 of cleaner 10 (shown in FIGS. 1–2). A DC servo motor 106 is provided for rotating housing 90 about bolts 94. Motor 106 is connected to a gear 106A which engages a wedge-shaped gear 108 bolted to scrubber frame 90. As motor 106 rotates gear 106A and gear 108, gear 108 acts as a lever and rotates housing 90 about bolts 94. Motor 106 is connected to a DC servo motor driver controlled by control subsystem 34, as will be described in further detail below.

Scrubber brush 80 is spun about its axis of rotation by a DC servo motor 86 through a belt and pulley mechanism. The belt and pulley mechanism consists of a pulley 82 connected to scrubber brush 80, a pulley 88 connected to motor 86, and a belt 84 looped over pulley 82 and pulley 88. Motor 86 is mounted on scrubber frame 90. Motor 86 is connected to DC servo motor driver in control subsystem 34, as will be described in further detail below.

Figure 7:
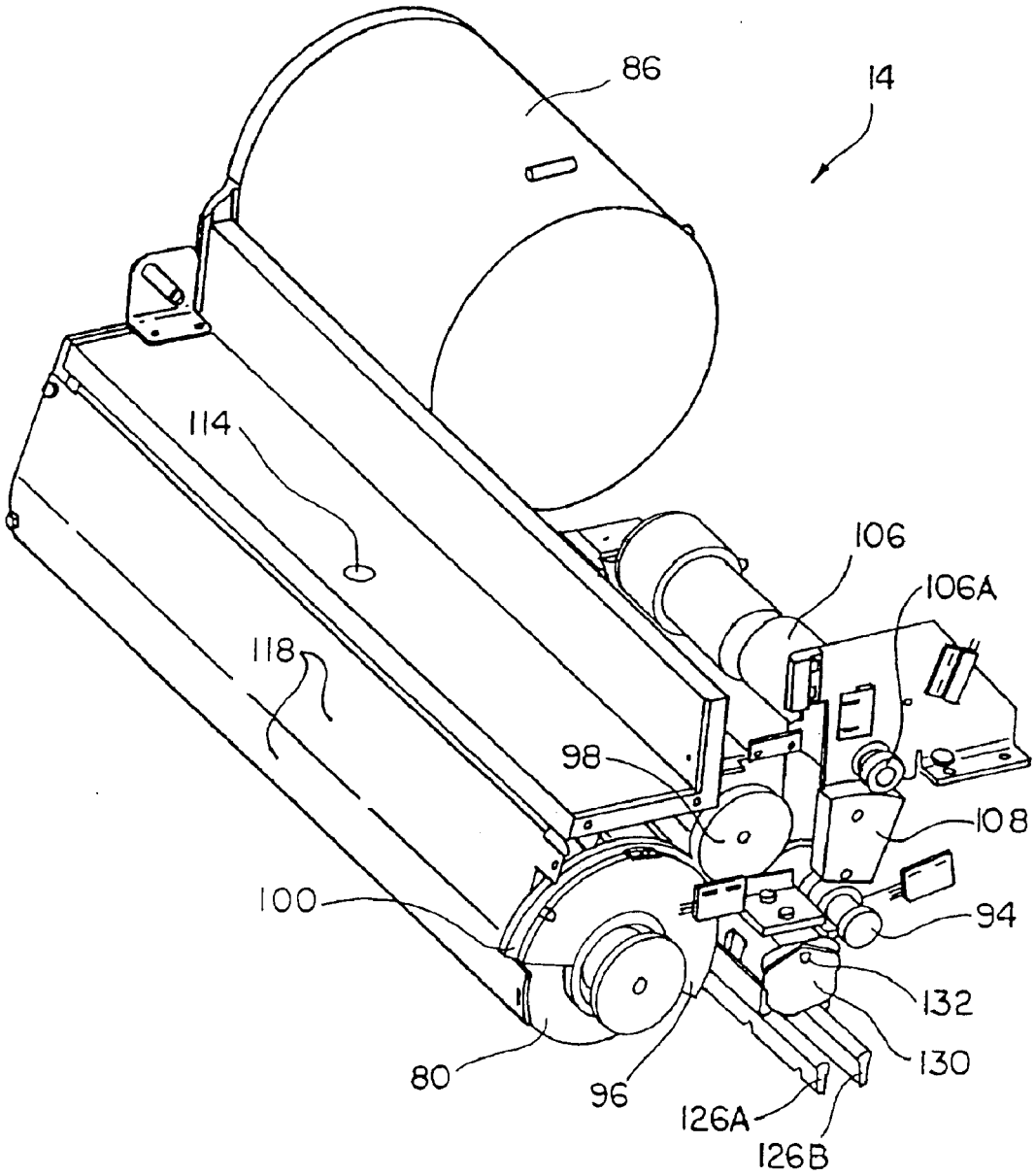
FIG. 7 is a top perspective view of the scrubber assembly of the cleaner, with an end plate removed for clarity.
Figure 8:
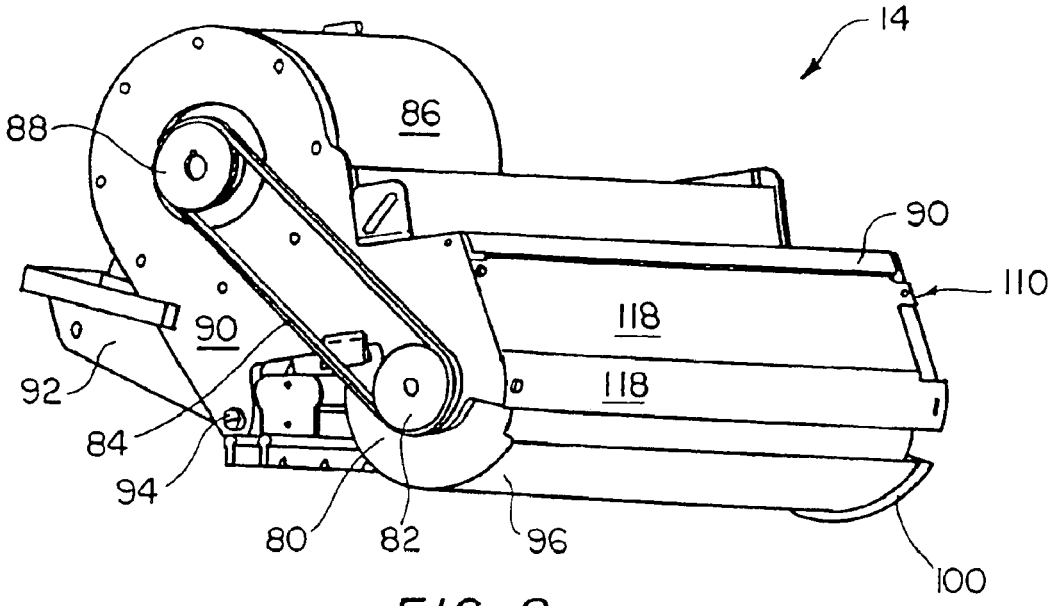
FIG. 8 is a bottom perspective view of the scrubber assembly with its splash and drip guard in a lowered position.
Figure 9:
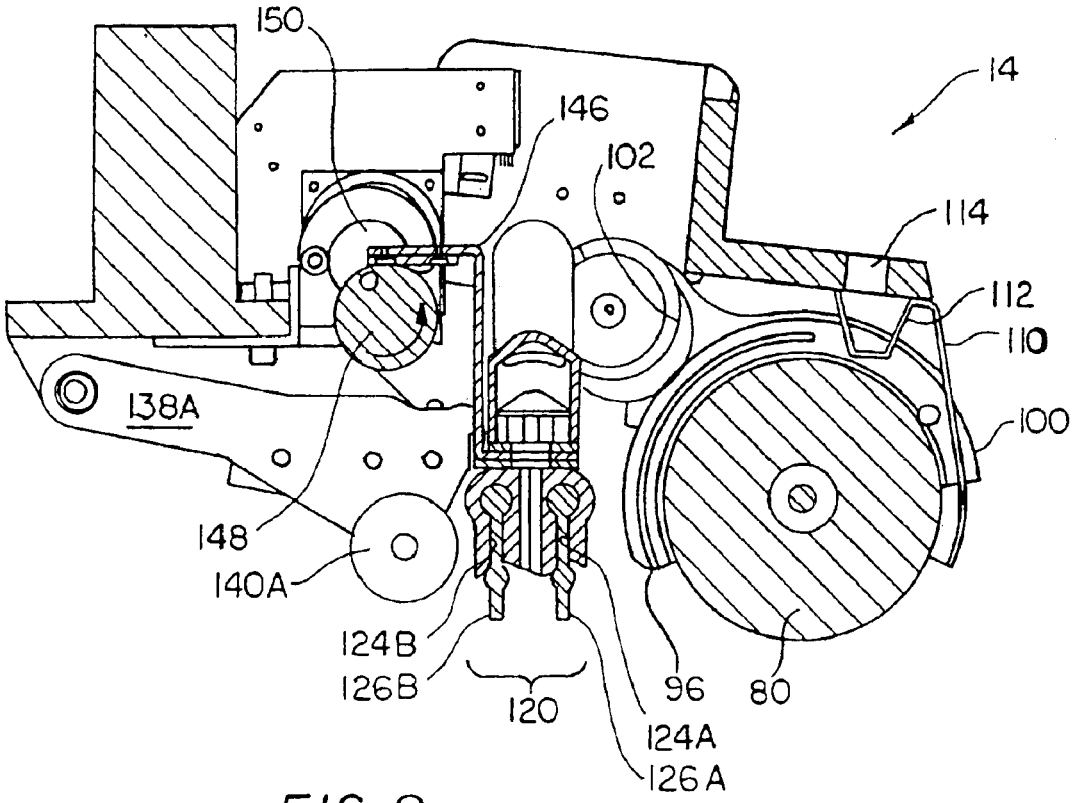
FIG. 9 is a cross-sectional view of the scrubber assembly with its splash and drip guard in a retracted position.
Figure 9A:
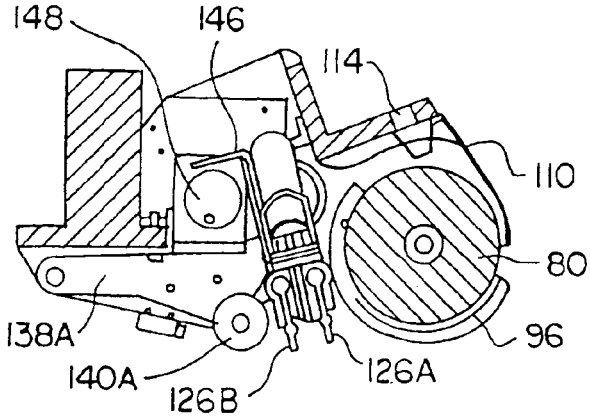
FIG. 9A is a cross-sectional view of the scrubber assembly with its splash and drip guard in its lowered position.

A splash and drip guard 96 extends the length of scrubber brush 80. Splash and drip guard 96 is rotatably mounted onto scrubber frame 90 and is rotatable around the axis of rotation of scrubber brush 80. When splash and drip guard 96 is retracted (as shown in FIGS. 7 and 9), splash and drip guard 96 prevents cleaning liquid from rotating scrubber brush 80 to splash against the inside of cleaner 10. When in its lowered position (as shown in FIGS. 8 and 9A), splash and drip guard 96 prevents cleaning solution from scrubber brush 80 to drip onto the floor.

The mechanism for lowering and retracting splash and drip guard 96 includes a geared lip 100 on splash and drip guard 96 and a gear 102. Gear 102 is driven by a motor 104 (shown in FIG. 10) which is connected to a DC servo motor driver controlled by control subsystem 34, as will be described in further detail below. When motor 104 rotates gear 102, gear 102 causes geared lip 100 and hence splash and drip guard 96 to rotate about the axis rotation of scrubber brush 80.

Figure 11:
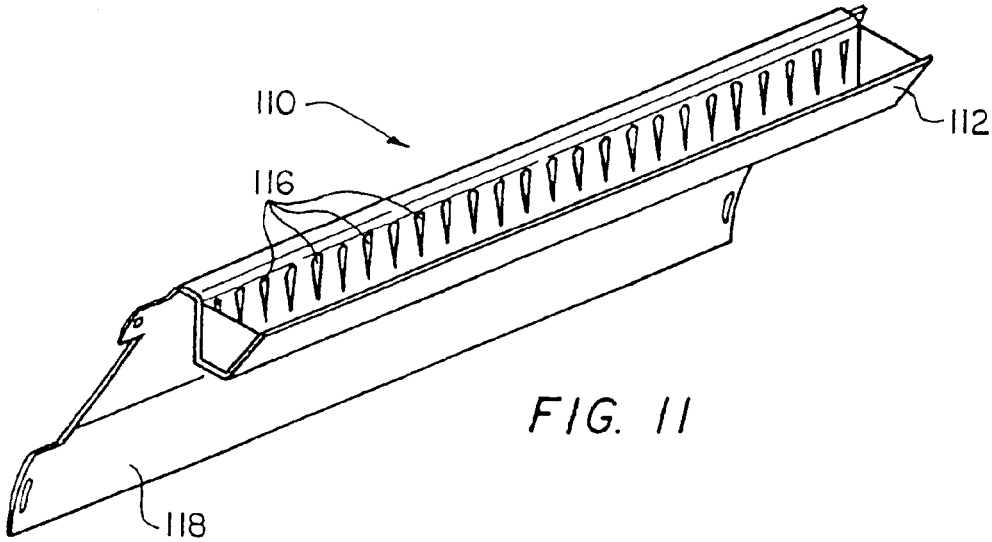
FIG. 11 is a perspective view of a liquid dispenser of the scrubber assembly.

Referring also to FIGS. 9 and 11, a cleaning solution dispenser 110 has a trough portion 112 into which cleaning solution is poured through an opening 114 in scrubber frame 90. A pipe (not shown) connects opening 114 to vacuum and liquid subsystem 30. Trough portion 112 of cleaning solution dispenser 110 includes a number of evenly spaced holes 16 which dispense cleaning solution evenly onto scrubber brush 80 along its length. Cleaning solution dispenser 110 also includes an integrated splash guard portion 118 protecting components of cleaner 10.

Figure 12:
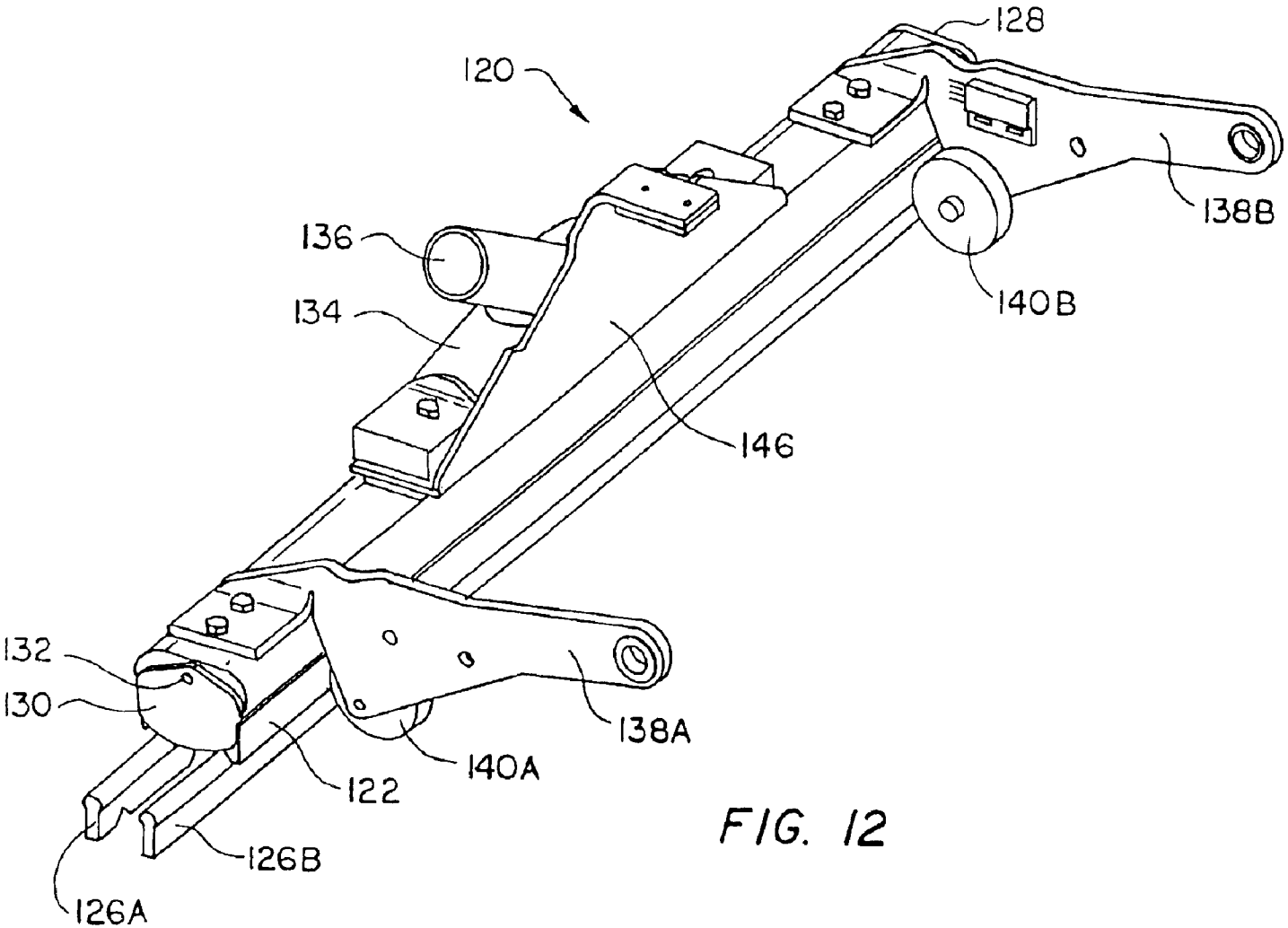
FIG. 12 is a perspective view of a squeegee assembly of the scrubber assembly.
Figure 12A:
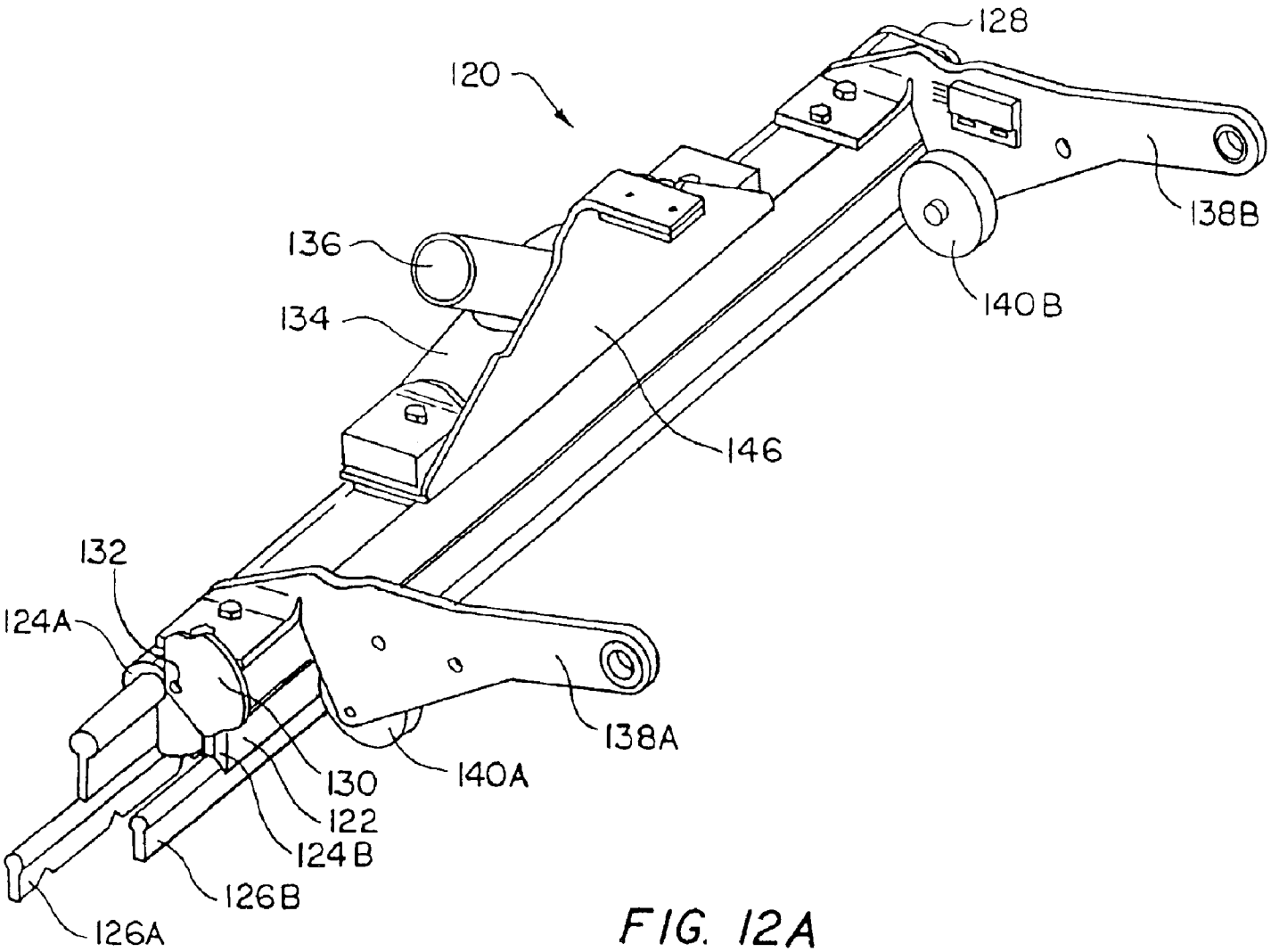
FIG. 12A is a perspective view of the squeegee assembly with one of its squeegee blades partially removed.
Figure 13:
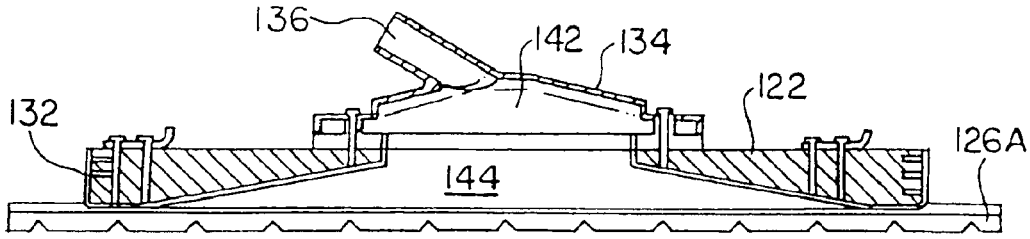
FIG. 13 is a cross-sectional view of the squeegee assembly.

Also referring to FIGS. 12, 12A and 13, scrubber assembly 14 also includes a squeegee assembly 120. Squeegee assembly 120 has a squeegee core 122 that is mounted onto left and right connecting members 138A–B. Connecting members 138A–B are pivotally mounted on mounting frame 92. Squeegee core 122 of squeegee assembly 120 has two key hole shaped grooves 124A–B which extend along the length of squeegee core 122. Grooves 124A–B are sized and shaped to receive squeegee blades 126A–B. Squeegee blades 126A–B have an upper portion which is key shaped and is sized to fit in the key-hole shaped grooves 124A–B. By key-hole shaped grooves, we refer to a groove which has a portion that is wider, or differently shaped, than at least one other portion of the groove, so that a properly sized and shaped key-shaped component inserted therein will resist a downward pulling force because of its shape and remains in the groove. To insert squeegee blades 126A–B into grooves 124A–B, squeegee blades 126A–B are slid along the length of grooves 124A–B. It should be noted that squeegee blade 126A, which is the leading squeegee blade, is ribbed so as to allow cleaning liquid collected in front of squeegee blade 126A to flow into the space between squeegee blades 126A–B to be collected by suction from vacuum and liquid subsystem 30.

At one end of grooves 124A–B, a cover 128 is bolted on squeegee core 122 for preventing squeegee blades 126A–B from sliding out of squeegee core 122. At the other end of grooves 124A–B, a cover 130 is pivotally mounted on squeegee core 122. Cover 130 is held in place over the groove openings by a spring loaded ball and detente mechanism 132.

Squeegee assembly 120 has a pair of wheels 140A–B which are installed on connecting members 138A–B, respectively. Wheels 140A–B rest on the floor surface during operation and prevent the weight of squeegee assembly 120 from crushing squeegee blades 126A–B.

Referring particularly to FIG. 13, squeegee assembly 120 further includes a vacuum plenum 134 mounted on squeegee core 122. Vacuum plenum 134 defines a cavity 142 which is continuous with a cavity 144 in squeegee core 122. Cavity 144 is located between grooves 124A–B. At the bottom of squeegee core 122, cavity 144 runs substantially the length of squeegee core 122 and opens into the space between squeegee blades 126A–B. Plenum 134 further includes a pipe 136 which connects to a vacuum hose (not shown) which leads to vacuum and liquid subsystem 30.

For lifting squeegee assembly 120, a bracket 146 is provided on squeegee assembly 120. A portion of bracket 146 rests on an off-center cam 148 which is coupled to a DC servo motor 150 is connected to a DC servo motor driver controlled by control subsystem 34, as will be described in further detail below. As motor ISO rotates cam 148, bracket 146 is lifted thereby lifting squeegee assembly 120.

During operation, vacuum and liquid subsystem 30 pumps cleaning liquid into trough portion 112. The pumped cleaning liquid falls onto scrubber brush 80 through openings 116 of trough portion 112. Then, scrubber brush 80, wet with cleaning liquid, is lowered to scrub the floor.

Suction from vacuum and liquid subsystem 30 creates a negative air pressure in cavities 142 and 144, and in the space between squeegee blades 126A–B. This negative air pressure results in air being removed from the space between the squeegee blades and in front of the leading squeegee blade 126A. Together with the air, the cleaning liquid on the floor surface, along with the dirt that is now in suspension, is also collected.

Squeegee assembly 120 is located relatively close to scrubber brush 80. Preferably the distance between the point of contact of scrubber brush 80 with the floor and the point of contact of the leading squeegee blade 126A with the floor is less than about 5 inches. Placing the squeegee assembly 120 relatively close to scrubber brush 80 results in at least two advantages. First, it results in making cleaner 10 more compact so as to enable mounting all of the components necessary for performing three cleaning operations on a single cleaning apparatus. Second, it allows squeegee assembly 120 to remove the cleaning liquid deposited by scrubber brush 80 shortly after it is deposited, thereby reducing the possibility of trails of cleaning liquid being left behind.

Vacuum and Liquid Subsystem

Referring to FIGS. 14, 14A, and 15–16, vacuum and liquid subsystem 30 includes a liquid recovery tank 190, a filter 192, a vacuum motor 194, and a fluid pump 196. A hose (not shown) connects liquid recovery tank 190 to pipe 136 of plenum 134. At liquid recovery tank 190, the hose connects to an end 198A of a pipe 198. Pipe 198 at another end 198B opens into the cavity of liquid recovery tank 190, near the top of liquid recovery tank 190. Liquid recovery tank 190 is filled such that the cleaning liquid level always remains below opening 198B of pipe 198. The cleaning liquid may be water or other cleaning liquids commonly used for scrubbing floors.

Vacuum motor 194 is connected to liquid recovery tank 190 through an air inlet 200. Air inlet 200 is capped by a wire mesh strain 202 which prevents foreign objects, such as hair, from reaching vacuum motor 194. Air inlet 200 and strain 202 are located inside a removable clear plastic dome 204. Plastic dome 204 allows the user to inspect strain 202 visually so as to remove any dirt collected by strain 202, if necessary.

Fluid pump 196 is connected to trough 112 (shown in FIG. 1I) through a hose 206. Fluid pump 196 is connected to liquid recovery tank 190 through filter 192. A fluid valve 196A is located between fluid pump 196 and filter 192. Some embodiments do not include a fluid valve. Fluid pump 196 and fluid valve 196A are connected to a dedicated driver controlled by control subsystem 34, as will be described in further-detail below.

As vacuum pump 194 operates, a negative pressure is created in liquid recovery tank 190 resulting in a suction being applied to pipe 198, and hence to plenum 134 and the space between squeegee blades 126A–8. The suction creates a flow of an air and now dirty cleaning liquid mixture collected from the space between squeegee blades 126A–B and the area in front of the leading squeegee blade 126A. As the flow of air and cleaning liquid mixture enters liquid recovery tank 190, the speed of the flow suddenly decreases since the volume in which the mixture can flow suddenly increases. The sudden decrease in the speed of the flow results in the liquid separating from the air and falling into the tank. Fluid pump 196 pumps the cleaning liquid in recovery tank 190 through filter 192 which removes the dirt particles in the cleaning liquid.

Burnisher Assembly

Figure 17:
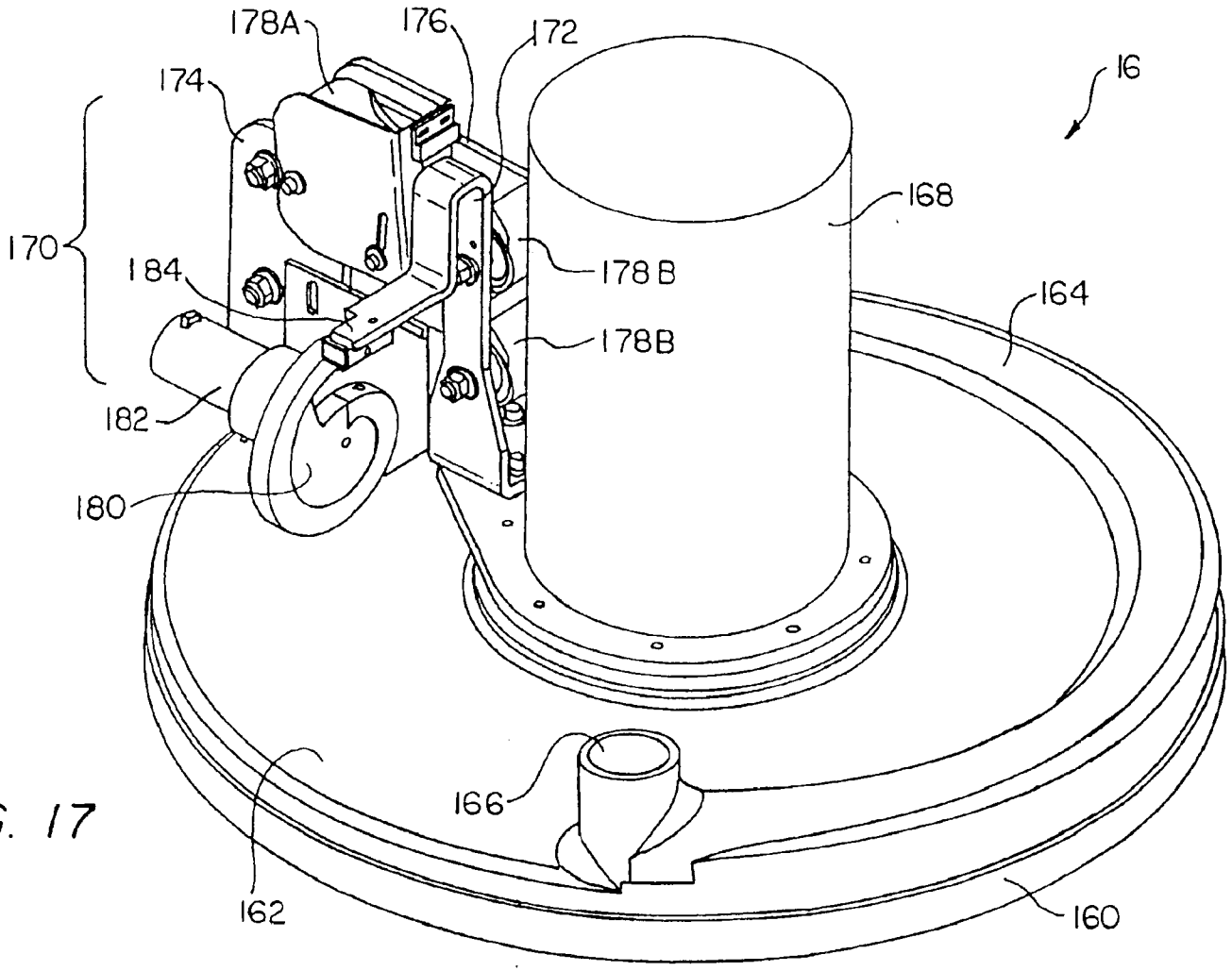
FIG. 17 is a perspective view of a burnisher assembly of the cleaner.
Figure 18:
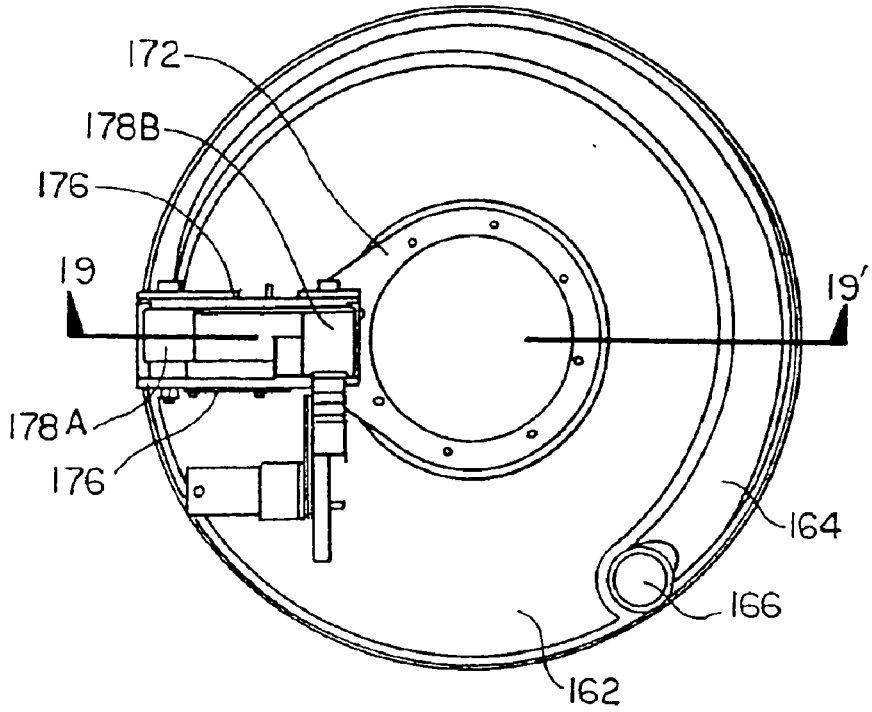
FIG. 18 is a top view of the burnisher assembly.
Figure 19:
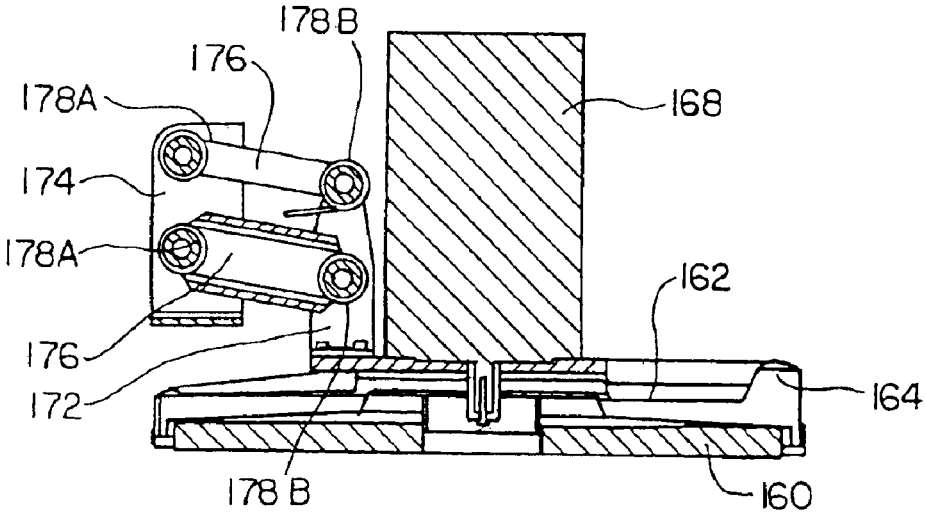
FIG. 19 is a cross-sectional view of the burnisher assembly.

Referring to FIGS. 17, 18 and 19, burnisher assembly 16 includes a burnisher pad 160, a burnisher pad cover 162, a motor 168 and a burnisher linkage assembly 170. Burnisher pad 160 is made out of porous, non-woven, air-layered fibrous material secured together with an adhesive binder. Preferably, burnisher pad 160 has characteristics previously proven suitable for use with commercial UHS finishes. Burnisher pad 160 is directly connected a DC servo motor 168 controlled by the control subsystem 34. Motor 168 can spin burnisher pad at speeds of up to about 3500 and preferably up to about 2800 rpm, and preferably at about or above 2100 rpm.

Burnisher pad cover 162 is characterized by a semicircular groove 164 which has a gradually rising profile. During operation, as motor 168 spins burnisher pad 160, burnisher pad 160 creates a spinning air flow which moves upward and carries dust particles from the floor surface with it. Groove 164 directs this air flow toward exit opening 166 and into a pipe (not shown) which is connected to a porous vacuum cleaner filter bag (not shown). The vacuum cleaner bag collects the dust but allows the air to flow out of the bag. Linkage assembly 170 is a spring loaded four bar linkage. Linkage assembly 170 includes a burnisher support member 172 and a mounting frame 174 for connecting burnisher assembly 16 to frame 18 of cleaner 10 (shown in FIGS. 1–2). Linkage assembly 170 includes four horizontal linkage bars 176, each of which is connected at one end to burnisher support member 172 and at another end to mounting frame 174. A pair of coil springs 178A are located at the mounting frame end of linkage bars 176. Another pair of coil springs 178B are located at the support member end of linkage bars 176. Coil springs 178A–B are mounted to resist the downward force exerted by the weight of burnisher pad 160, burnisher pad cover 162, and motor 168, and to allow burnisher pad 160 to float near the floor surface.

To lift and lower burnisher pad 160, burnisher assembly 16 includes a motor 182 connected to a cam 180. Cam 180 engages an extended portion 184 of support member 172. Motor 182 is connected to a DC servo motor driver controlled by control subsystem 34, as will be described in further detail below. As motor 182 rotates cam 180, burnisher pad 160 is either lifted or lowered. Note that the movement of burnisher pad 160 is substantially vertical. This substantially vertical movement reduces the extent to which burnisher pad 160 needs to be lifted so that all points of burnisher pad 160 have a predetermined clearance from the floor. Hence, the amount of space required for accommodating burnisher assembly 16 in its retracted position is less than otherwise may be the case, (hereby making it possible to have components for performing three cleaning operations on the same cleaning apparatus.

We have observed that having burnisher assembly 16 and scrubber assembly 14 on the same frame results in significantly improved cleaning results. The present system provides the advantage of performing multiple operations with a single pass of cleaner 10 over the floor. We have discovered that combining the burnishing operation with one or more of the sweeping and/or scrubbing operations, particularly the scrubbing operation, in a unitary, coordinated system so that the operations are performed serially provides certain advantages not previously achieved or recognized.

In particular, embodiments of cleaner 10 clean waxed floors with significantly better luster and shine than when the same cleaning operations are performed separately, in more than one pass, at widely spaced intervals as are typically performed by an operator using separate devices. We currently hypothesize that the improved results may be because the scrubbing and burnishing operations are performed closely spaced in time. In other words, it may be that the burnishing operation provides enhanced results when it is performed within a short time after the scrubbing operation resulting in increased gloss.

If that is the case, a cleaner, comprising a connected "train" of devices coordinated mechanically or electronically to perform the cleaning operations in the desired order and in close proximity in time, may achieve similar results.

We also currently hypothesize that the improved performance may be because scrubber assembly 14 when scrubbing the floor softens the wax or renders it plastic-like. Because burnisher assembly 16 starts burnishing shortly afterward, the wax is still in its softened or plastic state. Hence, the results of burnishing is significantly improved.

If that is the case, it may be possible to get the same advantage in other manner, so long as the wax remains in a softened or plastic state when the floor is burnished. For example, it is possible to use chemicals which reduce the rate of hardening of the wax after the scrubbing, resulting in the wax remaining in its plastic/softened state. Or, it may be possible to place a chemical on the floor or heat the floor to soften the wax or render it plastic-like just before burnishing the floor.

Control Subsystem

Control subsystem 34 receives inputs from the user, and, based on those inputs, operates cleaner 10. Control subsystem 34 also coordinates among various operations performed by cleaner 10. We will first describe the circuitry of control subsystem 34. We will then describe the application programs executed by subsystem 34.

Figure 20:
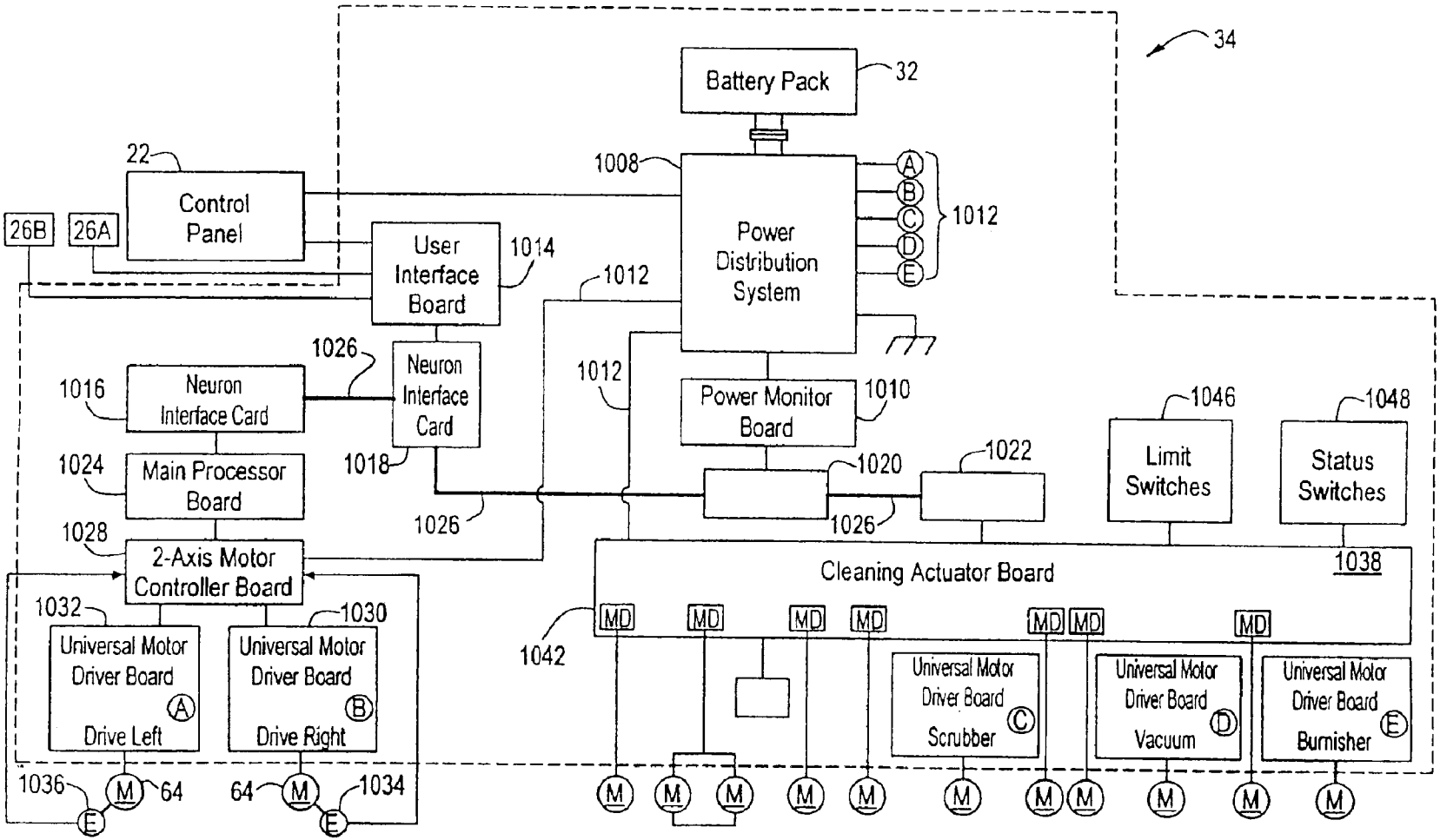
FIG. 20 is a schematic diagram of a control system of the cleaner.

FIG. 20 is a schematic diagram of the circuitry of control subsystem 34. Control subsystem 34 receives input signals from pressure sensing pads 26A–B and the controls on control panel 22 (shown in FIG. 1). These signals are received by a user interface board 1014. The signals associated with the emergency stop button and key switch are in addition received by a power distribution system 1008.

Power distribution system 1008 includes DC—DC converters that convert the voltage supply from batteries 32 (e.g., 36 or 48V) to various voltages required by various components of cleaner 10. Power distribution system 1008 also includes circuitry for performing a start-up sequence. During the start-up sequence, power distribution system 1008 measures the battery voltage and determines whether correct voltages are output by its the DC—DC converters. If correct voltages are output, power distribution system 1008 will turn on the rest of the components of control subsystem 34.

Power distribution system 1008 also implements a number of safety features. For example, in response to an input from the emergency stop button on control panel 22, power distribution system 1008 immediately cuts off all power to all components. Power distribution system 1008 also does not allow cleaner 10 to operate when housing 20 is not properly attached to frame 18 (FIG. 1).

A Power monitoring board 1010 monitors the overall power consumption of cleaner 10, and power consumption of each subsystem.

User interface board 1014, in response to signals from control panel 22 and pressure sensing pads 26A–B, generates commands to be transmitted to other components of control subsystem 34 through a neuron interface card 1018 connected to a system bus 1026. User interface board 1014 also sends signals to control panel 22 for lighting appropriate status LEDs to indicate to the user that various requested operations are being performed.

Control subsystem 34 includes a main processor board 1024 which includes a microprocessor for executing various application programs for operating cleaner 10. In the described embodiment, the microprocessor on processor board 1024 is an MC68332 processor manufactured by Motorola Corporation. Processor board 1024 is connected to system bus 1026 through a neuron interface board 1016.

Processor board 1024 also includes a memory for storing the application programs executed thereon.

Processor board 1024 is also connected to a two-axis motor controller board 1028 which controls the operation of drive wheel motors 64. Two-axis motor controller board 1028 receives velocity control commands with respect to drive wheel motors 64 from processor board 1024. Two-axis motor controller board 1028 translates the velocity control commands to appropriate DC analog signals for driving universal motor driver boards 1030–1032, each of which is respectively connected to one of drive wheel motors 64. Universal motor driver boards 1030–1032 amplify the received signals and directly drive motors 64.

The speed of each one of drive wheels 28A–B is monitored and controlled by a closed loop velocity control system implemented by encoders 1034–1036, two-axis motor controller board 1028, and the application programs running on processor board 1024. Generally, encoders 1034–1036 send signals corresponding to the speed of rotation of each one of drive wheels 28A–B to two-axis motor controller board 1028. Encoders 1034–1036 can be optical or magnetic encoders. Two-axis motor controller board 1028 translates the signals from encoders 1034–1036 to appropriate data transmitted to processor board 1024. The application programs running on processor board 1024 use the data to ensure that drive wheels 28A–B are rotating at correct speeds by adjusting the speed commands sent to two-axis motor controller board 1028, as will be described in detail below.

The circuitry of control subsystem 34 also includes a cleaning actuator board 1038 which receives instructions from application programs running on processor board 1024 through a neuron interface card 1027. Cleaning actuator board 1038 includes a microprocessor and a memory. The memory stores application programs which in response to the commands from processor board 1024 operate the various drivers and motors connected to cleaning actuator board 1038. Each one of the motors connected to cleaning actuator board 1038 is driven by a dedicated driver. Drivers for scrubber motor 86, vacuum pump 194, and burnisher motor 168 are not part of cleaning actuator board 1038. All other motor drivers (designated as 'MD') are part of cleaning actuator board 1038. A plurality of limit switches 1046 are positioned appropriately on cleaner 10, and are connected to cleaning actuator board 1038. Each one of limit switches 1046 provides a signal to cleaning actuator board 1038 when a moving component to which that limit switch connected reaches a predetermined position. For example, two limit switches are provided for sweeper assembly 12. One of those limit switches provides a signal to cleaning actuator board 1038 when sweeper assembly 12 reaches its lowered position. Another one of these limit switches provides a signal when sweeper assembly 12 reaches its retracted position. Similarly, three limit switches are provided for burnisher assembly 16 to provide indication of when burnisher assembly 16 reaches any one of its three positions. Other limit switches provide signals regarding the two positions of scrubber brush 80, the two positions of squeegee assembly 120, and the two positions of splash and drip guard 96. In addition to limit switches 1046, a set of status switches 1048 provide information with respect to whether liquid recovery tank 190 (shown in FIG. 15) is full or empty, and whether hopper 42 (shown in FIG. 5) is missing or is full.

Having described the circuitry of control subsystem 34, we will now describe the application programs running on processor board 1024 and cleaning actuator board 1038. These application programs generally have a behavior based architecture. Programs having behavior based architecture are typically used for robotics applications where a robot is conceptualized as having a number of interdependent behaviors, that is, behaviors which are in part independent of one another and in part dependent on one another. Typically, such programs are designed to have multiple behavior modules, where each one of the behavior modules is responsible for implementing one of the behaviors of the robot. All behavior modules typically run in parallel to one another on a same processor, or on different processors. Each behavior module can be thought of as a set of instructions that can be activated or deactivated based on outputs by other behavior modules or based on environmental conditions. Typically, there is more than one way for a behavior module to be activated or deactivated, and the behavior module can ac t differently depending on how it is activated or deactivated. For an over-view of behavior based programming see R. A. Brooks, "The Behavior Language; User's Guide" A.I. Memo 1227, Massachusetts Institute of Technology—Artificial Intelligence Laboratory, 1990.

We have found behavior based programming particularly suitable for cleaner 110. Cleaner 10 has various subsystems, each of which performs a particular cleaning function. The operation of each of these subsystems needs to be controlled partly independent of the operation of other subsystems and partly dependent on the operation of the other subsystems. In addition, the operation of each of the subsystems must be optimized in pall independently of the other subsystems and in part based on the operations of the other subsystem.

To understand this, consider the following subsystems of cleaner 10: scrubber assembly 14, burnisher assembly 16, and drive wheels 28A–B. These subsystems operate substantially independent of one another. However, in some respects, their operations depend on one another. For example, the speed at which burnisher pad 160 is spun depends on the speed at which cleaner 10 is driven. In addition, burnisher pad 160 should be preferably placed onto a particular area of the floor only after cleaner 10 has scrubbed that area. This minimizes damage to the floor. In the described embodiment, to ensure that burnisher pad 160 is placed over an already scrubbed area, burnisher pad 160 is lowered only after cleaner 10 has traveled a sufficient distance to ensure that burnisher pad 160 is over an area scrubbed by scrubber assembly 14. Moreover, to improve cleaning quality, after the operator has decided to stop scrubbing the floor, cleaner 10 should travel a sufficient distance so that squeegee assembly 110 removes cleaning liquid deposited by scrubber brush 80.

As already stated, behavior based programming allows having multiple behavior modules running in parallel enabling controlling and optimizing various subsystems independently of one another. At the same time, such programming allows coordination of the operation of various subsystems based on one another. In control subsystem 34, there are two levels of behavior modules. One set of behavior modules are high level behavior modules which are executed by processor board 1024. These behavior modules implement high level behaviors of cleaner 10 such as driving, sweeping, scrubbing, and burnishing. A second set of behavior modules are low level behavior modules which are executed by cleaning actuator board 1038. These behavior modules implement low level behaviors of cleaner 10 controlling operations of all of the motors on cleaner 10, except for drive wheel motors 64.

The high level behavior modules depend on independent and proper execution of the low level behavior modules. The high level behavior modules issue commands to the low level behavior modules. The low-level behavior modules then implement a sequence of steps to implement the particular, requested behavior. The high level behavior modules, after issuing commands, do not monitor the operation of the low level behavior modules and proceed to execute other steps. After receiving a command, the low level behavior modules do not require any further input from the high level behavior modules. In essence, the commands are implemented according to a "fire and forget" architecture: after issuing a command, the high level behavior modules can forget about the low level behavior and assume that it will be implemented. The architecture allows the high level behavior modules to be optimized for implementing the high level behaviors rather than for implementing the low level behaviors. This architecture also allows optimizing the low level behaviors solely for implementing the low level behaviors without any concern about the high level behaviors.

The low level behavior modules can be categorized and described based on the type of motors they operate. There are generally two types of motors in cleaner 10. The first type of motors operate the various components performing cleaning operations. These motors are sweeper brush motors 38A–B, scrubber brush motor 86, vacuum pump 194, fluid pump motor 196, and burnisher motor 168. The low level behavior modules controlling the operation of the first type of motors receive commands indicating that a motor should either start or stop operating. These lower level behavior modules translate those commands to instructions required by the corresponding drivers.

The second type of motors in cleaner 10 retract and lower various components of cleaner 10. These motors include sweeper lift motor 58, scrubber lift motor 106, splash and drip guard motor 104, squeegee lift motor 150, and burnisher lift motor 182. Each one of the low level behavior modules controlling the operations of these motors, after receiving a command, provide commands to a corresponding driver to start the appropriate motor. The behavior module then monitors signals from corresponding limit switches to determine when the component has reached the desired position and then sends commands to stop the motor.

Figure 21:
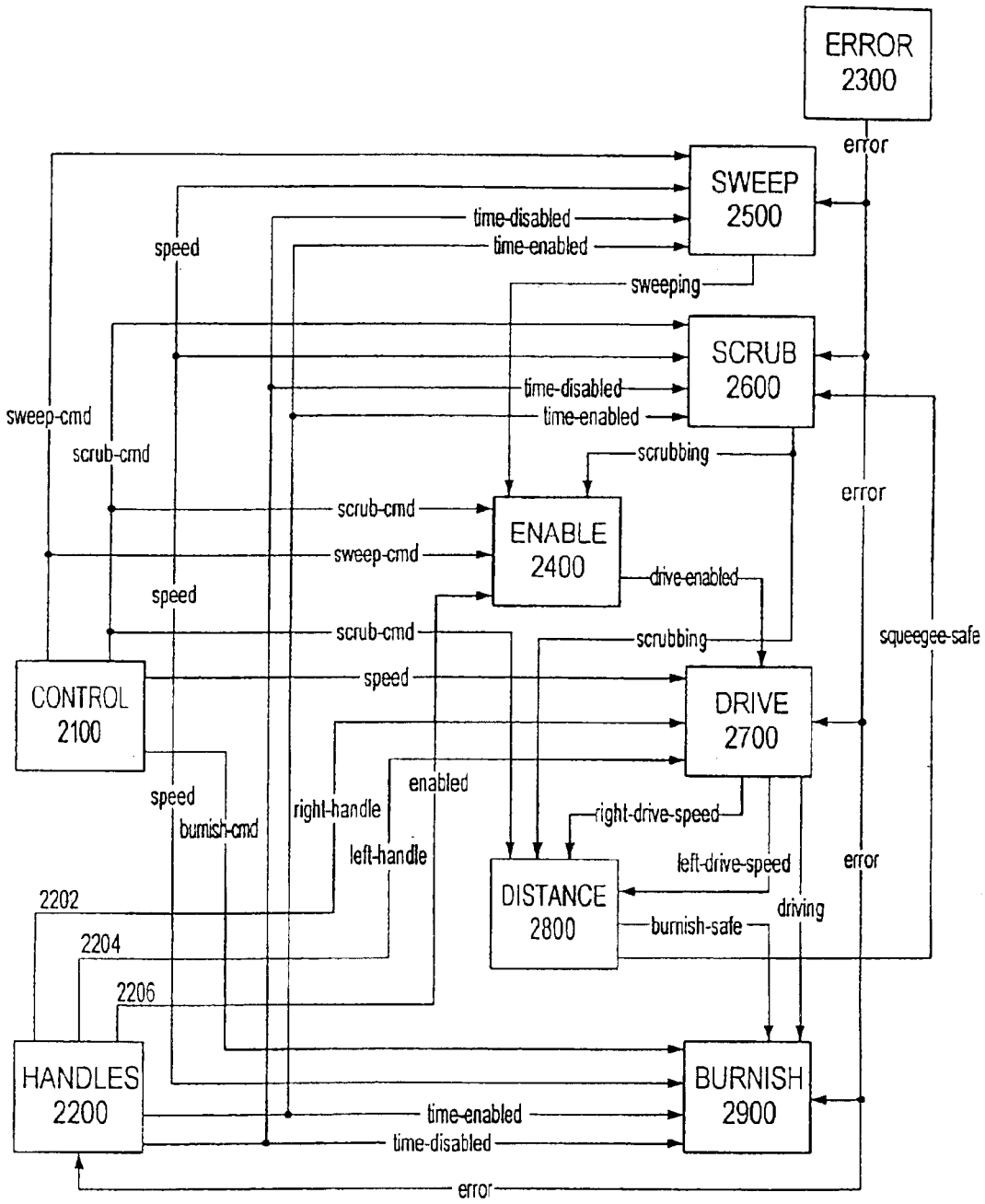
FIG. 21 is a behavioral diagram of an application program executed by the control system.

We will now describe the high level behavior modules in reference to FIGS. 21–30. FIG. 21, shows a behavior diagram of the high level behavior modules running on processor board 1024. There are nine separate behavior modules which run in parallel on processor board 1024. FIGS. 22–30 are pseudo codes for the steps taken by these nine behavior modules.

These nine behavior modules can be divided into three groups. The first group of behavior modules implement three user interface and error behaviors: control behavior module 2100, handles behavior module 2200, and error behavior module 2900. The second group of behavior modules implement two coordinating behaviors: enable behavior module 2400 and distance behavior module 2800. The third group of behavior modules implement four operational behaviors: sweep behavior module 2500, scrub behavior module 2600, drive behavior module 2700, and burnish behavior module 2800.

Referring to FIG. 22, error behavior module 2900 sets an ERROR flag when status switches 1048 indicate that hopper 42 is either missing, or liquid recovery tank 190 is either overflowing or empty. Error behavior module 2900 also sets the ERROR flag when there is a system error comprising an electronic detection of a mechanical problem (step 2902). The ERROR flag causes other behavior modules to stop all operations on cleaner 10.

Referring to FIG. 23, control behavior module 2100 translates data corresponding to signals from control panel 22 to output commands corresponding to the user's selections. These outputs include commands for commencing or stopping any one of the cleaning operations and a particular speed selected by the user.

Referring to FIG. 24, handles behavior module 2200 first determines whether the ERROR flag is set (step 2202). If so, handles behavior module 2200 sets RIGHT-HANDLE and LEFT-HANDLE variables to values corresponding to signals from left and right pressure sensing pads 26A–B (steps 2204). If either one of the RIGHT-HANDLE and LEFT-HANDLE variables is set, handles behavior module 2200 measures and outputs a TIME-ENABLED variable which measures the period since when one or both pressure sensing pads 26A–B have been pressed (step 2206). If neither one of pressure sensing pads 26A–B is pressed, handles behavior module 2200 outputs a TIME-DISABLED variable which measures the continuous period of time when neither one of the pressure sensing pads 26A–B has been pressed (steps 2208). Additionally, if either one of left and right pressure sensing pads 26A–B is pressed, handles behavior module 2200 sets an ENABLED flag (step 2210).

If the ERROR flag is set (step 2202), handles behavior module 2200 sets the ENABLED, RIGHT-HANDLED, LEF™-HANDLED, TIME-ENABLED, and TIME-DISABLED variables to false (steps 2212).

Referring to FIG. 25, enable behavior module 2400 implements a coordinating behavior and is responsible for setting a DRIVE-ENABLED flag which determines whether drive wheel motors 64 can operate drive wheels 28A–B. Enable behavior module 2400 sets the DRIVE-ENABLED flag when three conditions are met. First, the ENABLED flag must be set by handles behavior module 2200. Second, sweeper brushes 36A–B Must be either in their retracted or lowered positions. Third, scrubber brush 80 must be either in its retracted or lowered position. When all three conditions are met, enable behavior module 2400 sets the DRIVE-ENABLED flag. Enable behavior module 2400 thereby prevents movement of cleaner 10 when pressure sensing pads 26A–B are not being pressed, sweeper brushes 36A–B are in the process of being retracted or lowered, or scrubber brush 80 is in the process of being retracted or lowered.

Referring to FIG. 26, sweep behavior module 2500 implements the sweeping behavior of cleaner 10. If the SWEEP-CMD flag is set, the SPEED variable is not set for reverse speed, and the ERROR flag is not set (step 2502), sweep behavior module 2500 provides commands to turn on sweeper brush motors 38A–B and to lower sweeper brushes 36A–B (steps 2504). Sweep command behavior module 2500 starts sweeper brush motors 38A–B only after the value of the TIME-ENABLED variable is greater than a predetermined DELAY-ON-SWEEP-START constant. Similarly, sweep command behavior module 2500 sends the command for lowering sweeper brushes 36A–B only after the TIME-ENABLED variable is greater than a predetermined DELAY-ON-SWEEP-LOWER constant. These delays ensure that sweeping does not begin until after the operator has applied pressure to pressure sensing pads 26A–B for a predetermined period of time. Sweep command behavior module 2500 also sets a SWEEPING flag indicating that the cleaner 10 has begun sweeping the floor (steps 2506).

If the TIME-DISABLED variable is greater than a DELAY-OFF-SWEEP-RAISE constant, indicating that the user has removed his hands from pressure sensing pads 26A–B for more than a predetermined period of time, sweep behavior module 2500 stops sweeping operation by first raising sweeping brushes 36A–B (steps 2508). After a further delay determined by a DELAY-OFF-SWEEP-STOP constant, sweep behavior module 2500 stops sweeping brush motors 38A–B (steps 2510). These delays ensure that cleaner 10 continues to sweep, even when the operator removes his hands from the pressure sensing pads 26A–B momentarily. At the same time, stopping the sweeping (and other operations, as will be described below) ensures that cleaner 10 does not operate unless there is an operator present. This is an important "time out" safety feature of cleaner 10.

If the SWEEP-CMD flag is not set, the SPEED variable is set for reverse speed, or the ERROR flag is set (step 2502), then sweep behavior module 2500 stops cleaner 10 from sweeping immediately and sets the SWEEPING flag to false (steps 2512).

Referring to FIG. 27, scrub behavior module 2600 implements scrubbing behavior of cleaner 10. If the SCRUB-CMD flag is set, the SPEED variable is not set for reverse, and the ERROR flag is not set, then scrub behavior module 2600 determines whether the TIME-ENABLED variable is greater than a predetermined DELAY-ON-SCRUB-START constant indicating that the user has applied pressure to pressure sensing pads 26A–B for a sufficiently long time for cleaner 10 to start scrubbing (step 2602). If so, scrub behavior module 2600 issues commands for retracting splash and drip guard 96, starting scrubber brush motor 86, starting vacuum pump 194, lowering squeegee assembly 120, and opening fluid valve 196A (steps 2604). If scrub behavior module 2600 determines that the TIME-ENABLE variable is greater than a further DELAY-ON-SCRUBBER-LOWER constant, scrub behavior module 2600 starts fluid pump 196, lowers scrubber brush 80, and sets a SCRUBBING flag to indicate that cleaner 10 is scrubbing the floor (steps 2606).

If scrub behavior module 2600 determines that the TIME-DISABLE variable is greater than a predetermined DELAY-OFF-SCRUBBER-RAISE constant, indicating that the user has stopped applying pressure to pressure sensing pads 26A–B, scrub behavior module 2600 stops cleaner 0 from scrubbing (steps 2608). To do so, scrub behavior module 2600 first determines whether the TIME-DISABLED variable is greater than a DELAY-OFF-SCRUBBER-RAISE constant. If so, scrubber brush 80 is lifted, the SCRUBBING flag is set to false, and fluid pump 196 is shut off. If scrub behavior module 2600 then determines that the TIME-DISABLED variable is greater than a predetermined DELAY-OFF-SCRUBBER-STOP constant, scrub behavior module 2600 shuts off scrubber brush motor 86, and closes fluid valve 196A (steps 2610). Scrub behavior module 2600 then proceeds to lower splash and drip guard 96, raise squeegee assembly 120, and turn off vacuum pump 194, but only after determining that a SQUEEGEE-SAFE flag is set. The SQUEEGEE-SAFE flag indicates whether squeegee blades 126A–B have traveled a sufficient distance to remove the cleaning liquid deposited by scrubber brush 80 before it was lifted (steps 2612). The SQUEEGEE-SAFE flag is set by distance behavior module 2800, as will be described below.

If the SCRUB-CMD flag is not set, the SPEED variable is set to reverse, or the ERROR flag is set, scrub behavior module 2600 stops cleaner 10 from scrubbing, without any delay. To do so, scrub behavior module 2600 sends commands to raise scrubber brush 80, set the SCRUBBING flag to false, shut off fluid pump 196, turn off scrubber brush motor 86, and close fluid valve 196A (steps 2614). If the SPEED variable is set to reverse or the ERROR flag is set, scrub behavior module 2600 also sends commands to lower splash and drip guard 96, raise squeegee assembly 120, and turn off vacuum pump 194 (steps 2616). Otherwise, these steps are taken only after the SQUEEGEE-SAFE flag is set indicating that squeegee assembly 120 has traveled over an area cleaned by scrubber brush 80 and hence has removed the cleaning liquid deposited by scrubber brush 80 on the floor.

Referring to FIG. 28, drive behavior module 2700 implements the driving behavior of cleaner 10 by controlling the operation of drive wheels 28A–B of cleaner 10. To do so, drive behavior module 2700 implements two functions. First, drive behavior module 2700 monitors and adjusts the speed of drive wheels 28A–B to ensure that they track a speed selected by the user. Second, drive behavior module 2700 controls the direction of travel of cleaner 10.

To implement the first function, drive behavior module 2700 compares the current speed of each one of drive wheels 28A–B to the speed selected by the user. As discussed above, the current speed is measured by encoders 1034–1036 (shown in FIG. 20). If the current speed of either one of drive wheels 28A–B is not the same as the speed selected by the user, drive behavior module 2700 adjusts the speed of that drive wheel to more closely track the selected speed (steps 2702). As mentioned above, in this manner, a closed-loop velocity control of drive wheels 28A–B is implemented in cleaner 10. To implement the second function, drive behavior module 2700 controls the speed of drive wheels 28A–B individually to move cleaner 10 forward and backward, turn cleaner 110 to the left or right, and stop cleaner 110. To implement a left turn, drive behavior module 2700 stops left drive wheel 28B from rotating and allows fight drive wheel 28A to continue to rotate. To implement a right turn, drive behavior module 2700 stops right drive wheel 2813 from rotating and allows left drive wheel 28A to continue to rotate. To stop cleaner 110, drive behavior module 2700 stops both drive wheels 28A–B. To move cleaner 10 forward or in reverse in a straight line, drive behavior module 2700 rotates both drive wheels 28A–B at the same speed and in the same direction.

We will now describe the specific manner in which drive behavior module 2700 implements the above method of directional control. First, drive behavior module 2700 determines whether the DRIVE-ENABLED flag is set and the ERROR flag is not set (step 2704). Then, if the user is pressing left pressure sensing pad 26B, drive behavior module 2700 sets speed of right drive wheel 28A to the speed selected by the user (steps 2706). If the user is not pressing left pressure sensing pad 26B, drive behavior module 2700 sets speed of right drive wheel 28A to zero causing the right drive wheel to stop (steps 2708). In a similar fashion, if the user is pressing right pressure sensing pad 26A, drive behavior module 2700 sets speed of left drive wheel 28B to the speed selected by the user (steps 2710). If the user is not pressing right pressure sensing pad 26B, drive behavior module 2700 sets speed of left drive wheel 28B to zero causing the left drive wheel to stop (steps 2712). If either one of the left and right pressure sensing pads 26A–B is being pressed, drive behavior module 2700 sets the DRIVING flag to true (steps 2714). If neither one of the pressure sensing pads 26A–B is being pressed; drive behavior module 2700 sets the DRIVING flag to false (steps 2716). In this case, drive behavior module 2700 also sets the speed of both wheels to zero, thereby stopping cleaner 10 (steps 2718).

Referring to FIG. 29, distance behavior module 2800 implements a coordinating behavior for coordinating among scrub behavior module 2600, drive behavior module 2700, and burnish behavior module 2900. Generally, distance behavior module 2800 ensures that burnishing does not begin until cleaner 10 has traveled a sufficient distance to be located over an area already scrubbed by scrubber assembly 12. Distance behavior module 2800 also ensures that squeegee blades 126A–B are not lifted from the floor until cleaner 10 has traveled a sufficient distance for squeegee assembly 120 to remove the cleaning liquid deposited by scrubber brush 80. To implement these functions, drive behavior module 2800 supplies flags to scrub behavior module 2600 and burnish behavior module 2900 to either prevent from performing their particular cleaning operations, or allow them to perform their cleaning operations.

Distance behavior module 2800 first determines whether scrubber assembly 12 is scrubbing (step 2802). If so, distance behavior module 2800 calculates the distance traveled by cleaner 10 based on the actual speeds of the left and right drive wheels 28A–B determined by readings from encoders 1034–1036, and rate of velocity updates (steps 2804). In alternative embodiments, the distance can be estimated by a predetermined time constant, or by the speed selected by the user rather than the actual speed. If Distance behavior module 2800 determines that the SCRUBBING flag is false, indicating that scrubber assembly 12 is not currently scrubbing, distance behavior module 2800 sets a BURNISH-DISTANCE variable to false, thereby preventing burnish behavior module 2800 from starting the burnishing.

If distance behavior module 2800 determines that the SCRUBBING flag is set, then distance behavior module 2800 sets SQUEEGEE-DISTANCE and SQUEEGEE-TIME variables to false (steps 2806).

If Distance behavior module 2800 determines that the SCRUBBING flag is not set and the SQUEEGEE-DISTANCE variable is false, indicating that scrubber assembly just finished scrubbing, then Distance behavior module 2800 sets the SQUEEGEE-DISTANCE variable to zero (steps 2808). The SQUEEGEE-DISTANCE variable indicates the distance cleaner 10 travels from the time scrubber assembly 12 stops scrubbing. Distance behavior module 2800 also sets the SQUEEGEE-TIME variable to the appropriate time when squeegee blades 126A–B must be lifted off the floor, if not already lifted (step 2810).

If the SCRUBBING flag is not set and the SQUEEGEE-DISTANCE variable is not false, distance behavior module 2800 determines that scrubber assembly 12 has finished scrubbing and distance behavior module 2800 is in the process of measuring the distance traveled by cleaner 10 since scrubbing stopped. Hence, distance behavior module 2800 calculates the distance based on the actual speeds of left and right drive wheels 28A–B determined by readings from encoders 1034–1036, and rate of velocity update (steps 2812). Distance behavior module 2800 then determines whether the SQUEEGEE-TIME variable has been set, indicating that scrubber assembly 12 has finished scrubbing (step 2814). If so, distance behavior module 2800 determines whether cleaner 10 has traveled a sufficient distance or whether sufficient time has passed, so that squeegee blade 126A–B should be lifted anyway (steps 2816). Distance behavior module 2800 then sets the SQUEEGEE-SAFE flag accordingly (steps 2818). As described above, SQUEEGEE-SAFE flag is used by scrub behavior module 2700 to determine whether to lift squeegee blades 126A–B.

Next, distance behavior module 2800 determines whether cleaner 10 has traveled sufficient distance for burnisher assembly 16 to begin burnishing (step 2820). Distance behavior module 2800 sets a BURNISH-SAFE flag accordingly (steps 2822).

Referring to FIG. 30, burnish behavior module 2900 implements burnishing behavior of cleaner 10. If a BURNISH-CMD flag is set, the SPEED variable is not set for reverse, and the ERROR flag is not set (steps 2902), then burnish behavior module 2900 determines whether the TIME-ENABLED variable is greater than a predetermined DELAY-ON-BURNISH-START constant. If the TIME-ENABLED variable is greater that the DELAY-ON-BURNISH-START constant, burnish behavior module 2900 determines that the user has applied pressure to pressure sensing pads 26A–B for a sufficiently long time for cleaner 10 to start burnishing. Burnish behavior module 2900 then issues a command to start burnisher motor 168 (steps 2902). Note that burnisher motor 168 spins at different speeds, depending on the speed of cleaner 10 selected by the user. If the BURNISH-SAFE flag and the DRIVING flag are set, burnish behavior module 2900 sends a command for lowering burnisher pad 160 to the floor and sets a BURNISHING flag (steps 2906). Otherwise, burnish behavior module 2900 retracts burnisher pad 160 to its intermediate position (steps 2908).

If burnish behavior module 2900 determines that the TIME-DISABLE variable is greater than a predetermined DELAY-OFF-BURNISHER-STOP constant, indicating that the user has stopped applying pressure to pressure sensing pads 26A–B, burnish behavior module 2900 stops cleaner 10 from burnishing (steps 2910). To do so, burnish behavior module 2900 sends a command to retract burnisher pad 160 to its intermediate position, sets the BURNISHING flag to false, and turns off burnisher motor 168 (steps 2910).

If burnish behavior module 2900 determines that the TIME-DISABLE variable is greater than a predetermined DELAY-OFF-BURNISHER-RAISE constant, burnish behavior module 2900 sends a command to retract burnisher pad 160 completely (steps 2914).

If BURNISH-CMD is not set, the SPEED-variable is set to reverse, or the ERROR flag is set, then burnish behavior module 2900 stops cleaner 10 from burnishing immediately without delay. To do so, burnish behavior module 2900 retracts burnisher pad 160 completely, sets BURNISHING flag to false, and turns off burnisher motor 168.

Figure 15:
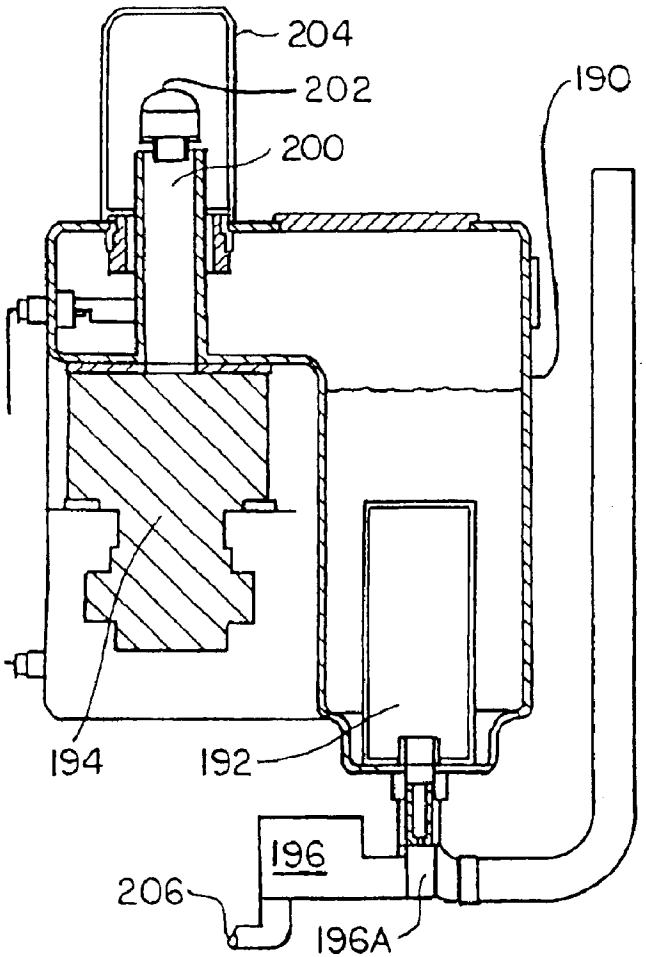
FIG. 15 is a cross-sectional view of the fluid and vacuum system.

In this way, the operation of cleaner 10, FIG. 1 and each of the primary components thereof, namely drive wheels 28A–B, FIG. 2; sweeper assembly 12; scrubber assembly 14 including vacuum 194, FIG. 15; squeegee assembly 126A–B, FIG. 7, and fluid pump 196, FIG. 15; and burnisher assembly 16, FIG. 1 is greatly simplified by the implementation and architecture of control system 34, FIG. 20.

Without such a control system, the user, to begin cleaning a floor, would be required, inter alia, to engage drivewheels 28A–B, FIG. 2, lower sweeper assembly 12, engage sweeper motors 38A–B, lower scrubber assembly 14 and squeegee assembly 12, engage scrubber motor 86, FIG. 8, turn on vacuum pump 194, FIG. 15 and fluid pump 196, and then lower burnisher assembly 16, FIG. 2 and activate burnisher motor 168, FIG. 17 to rotate burnisher pad 160.

Each time the cleaner is stopped, the user would then be required to reverse this process.

As such, although cleaner 10 uniquely includes three cleaning heads, control system 34 or its equivalent is highly desirable: otherwise the operational requirements of cleaner 10 would be overly complex.

In this invention, control system 34 renders the operation of cleaner 10 nearly autonomous to the extent that cleaning is effected by the user issuing only two commands and, conversely, the cleaning apparatus automatically ceasing to operate, when the user issues only one command, without damaging the floor and without leaving cleaning fluid on the floor.

In operation, the user typically enters a cleaning mode command via control panel 22 and touches one or both of pressure sensing pads 26A–B, FIG. 1.

Figure 10:
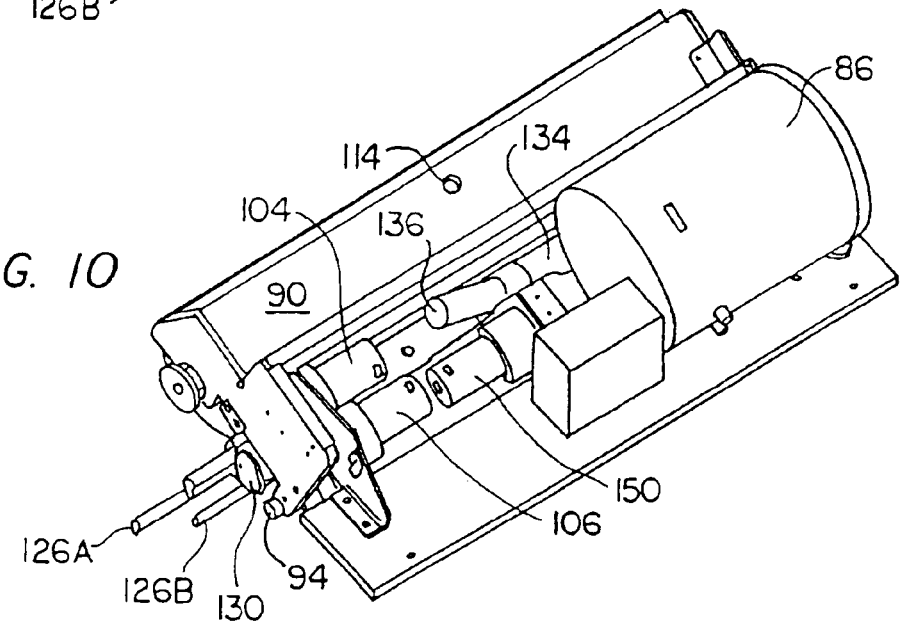
FIG. 10 is a top perspective view of the scrubber assembly.
Figure 14A:
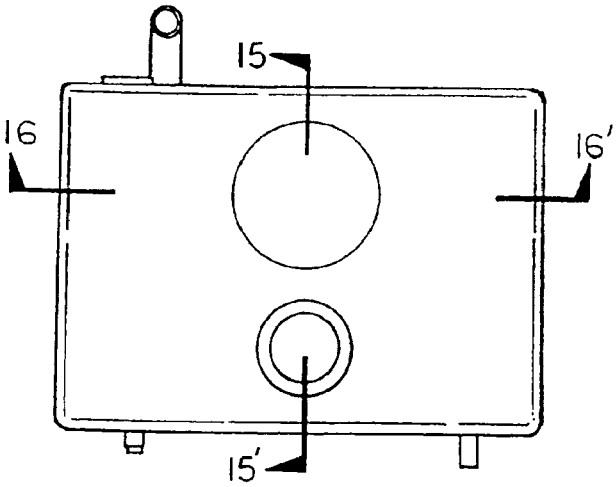
FIG. 14A is a top view of the fluid and vacuum system.
Figure 14:
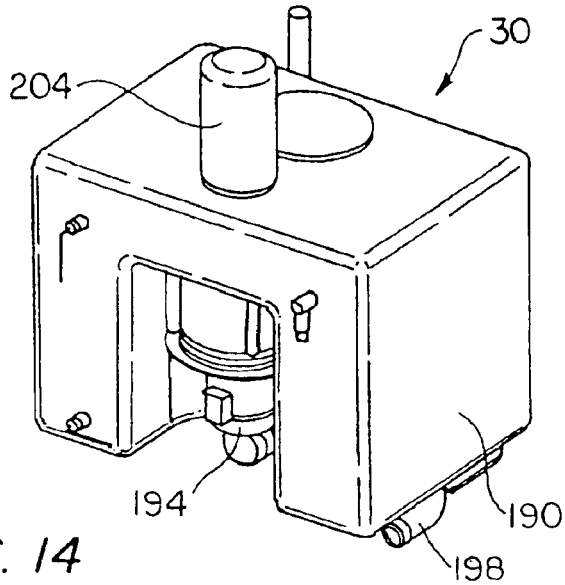
FIG. 14 is a perspective view of a fluid and vacuum system of the cleaner.
Figure 16:
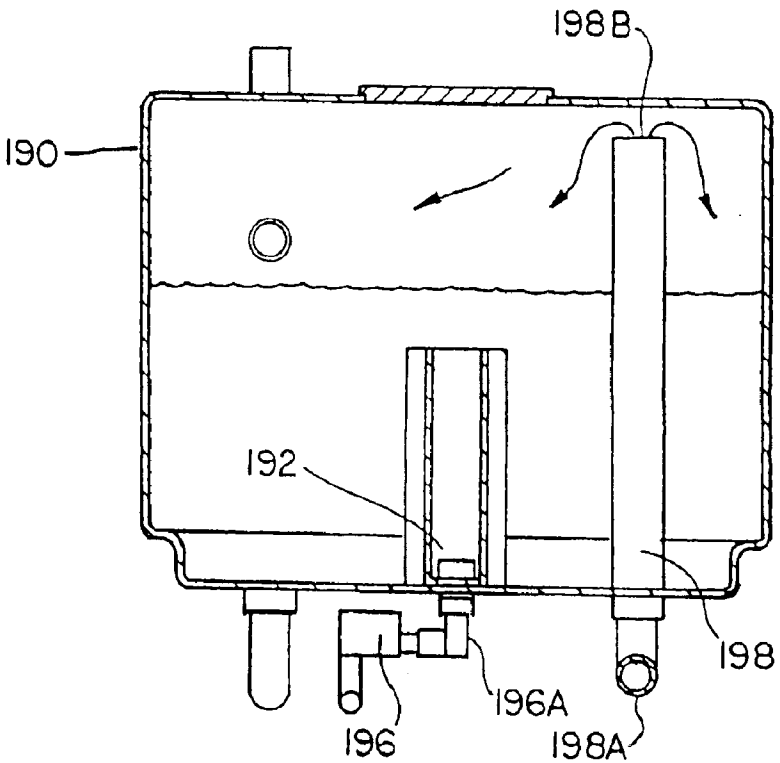
FIG. 16 is another cross-sectional view of the fluid and vacuum system.

Control system 34, FIG. 20 then automatically signals drive motor 64, FIG. 2 to turn drivewheels 28A–B, signals motors 38A–B to turn sweeper brushes 36A–B, provides signals to sweeper assembly 12 motor 58, FIG. 5 which lowers hopper 42 and sweeper brushes 36A–B, signals scrubber brush 80 motor 86, FIG. 14 which, in response, spins scrubber brush 80, provides signals to motor 106 to lower scrubber brush 80 and squeegee assembly 126A–B, signals motor 104, FIG. 10 to rotate splash guard 96, FIG. 9A, provides signals to vacuum pump 194, FIG. 15 and fluid pump 196 to turn them on, signals burnisher motor 168, FIG. 17 to rotate burnisher pad 160, and finally, signals burnisher assembly 16 motor 182 to lower burnisher assembly 16, FIG. 2.

Preferably, control system 34, FIG. 20 performs these operations automatically in the sequence listed above but this particular sequence is not a limitation of the present invention. Indeed, once the drive wheels begin to turn, all of the cleaning heads may begin to rotate and all of the cleaning assemblies lowered at the same time as the vacuum pump and the fluid pump are energized.

When the operator removes his hands from both sensing pads 26A–B, FIG. 1, enters any mode command other than the cleaning mode command, and/or if an error flag is detected, control system 34 essentially reverses the sequence of operations listed above except that, in the preferred embodiment, signals are first provided to turn fluid pump 196 off before vacuum pump 194 is turned off, before squeegee assembly 120 is raised, before burnisher assembly 16, scrubber assembly 14, and sweeper assembly 12 are raised, and before the operation of burnisher pad 160, scrubber brush 80, and sweeper brushes 36A–B stops.

Typically, at least vacuum pump 194 remains on and squeegee assembly 120 lowered for the deceleration period of cleaner 10.

In this way, control system 34 greatly simplifies the operation of cleaner 10 and, at the same time, insures that the floor is not damaged and/or that cleaning fluid is not left on the floor.

Although control system 34 is described above with respect to a cleaner with three cleaning heads, control system 34 could be modified accordingly and implemented in a cleaner with only a scrubbing brush or pad and a burnishing pad or pads. Moreover, although a behavior based architecture is described, control system 34 could be implemented using different software algorithms or even electronic circuitry without processors. Accordingly, control system 34 and its associated circuitry could be implemented based on microprocessor software algorithms including but not limited to behavior based architectures or based on analog or digital circuitry architectures.

While not intending to be bound by any particular explanation for the phenomena resulting from the practice of the present invention, it is believed that a combination of factors may be contributing to the surprising results achieved by the present invention. It is known that some polymeric coatings are hydrophilic in character and tend to absorb some water on contact. Typically the repair of the surface of the coating involves primarily a thin region near the surface of the coating. Performing the burnishing closely in time after the scrubbing may permit the burnishing to occur while the surface region of the polymeric coating contains some absorbed wash water. At this time, the surface of the coating may be temporarily in a softened, malleable plastic state as a result of absorption of a portion of the washing liquid. This effect may be enhanced with particularly hydrophilic coatings or by the use of surfactants or other additives added to the washing liquid. The liquid begins to evaporate into the air from this thin surface zone quickly after the bulk liquid is removed form the surface so that in conventional practice the burnishing operation is performed after the coating has already dried and hardened. In the dry state, the coating is more frangible or friable and is subject to creation of scratches. However, while the coating contains a substantial amount of the additional, absorbed liquid it may temporarily be in a softer and more malleable state and is more likely to flow and be deformed or displaced rather than scratched or broken. This may result in a smoother surface being created by the burnishing operation. Thus, it is a feature of the method and device of the present invention that the burnishing take place while the coating contains a significant amount of additional water and before it has transitioned back to the hard, dry state. A squeegee, vacuum or other mechanism is located following the scrubber to remove bulk water from the surface of the floor after scrubbing and before burnishing. Because the coating begins to dry after the bulk water is removed from the surface, it is desirable that the burnisher be placed as close as practical after the point where the bulk surface water is removed. Also, it is preferred that the bulk liquid removal point be located so that the water will have sufficient time to penetrate the coating before removal. A device according to the present invention will generally have the burnishing mechanism within about 10 to about 40 cm of the rear of the scrubbing mechanism. Preferably the leading edge of the burnishing mechanism is within about 25 cm from the point of bulk liquid removal and preferably within about 10 cm.

The cleaning machine according to the present invention will often traverse the floor at the rate of about 45–55 cm per second. The placement of the burnisher closely following the scrubber in the device of the present invention will ensure that the burnishing takes place within about three quarters of a second after completion of scrubbing and less than about one-half second after the removal of bulk liquid while the coating still contains substantial absorbed water and is still in the softened, plastic state when burnished. This will also ensure that the device is small enough to operate in the intended cleaning environment.

Yet another factor that may contribute to the surprising results of the present invention is the use of a relatively soft brush as the main scrubbing element. The scrubbing pads in conventional scrubbers are generally nonwoven pads which are quite aggressive in order to clean the coating and in so cleaning they remove a portion of the coating leaving it in a "damaged" state, e.g., having lower gloss than before the scrubbing operation. It is counterintuitive to expect a softer brush would provide improved floor coating maintenance. However a softer, bristled brush appears to clean effectively yet cause relatively little loss of gloss in the polymer coating. This results in the burnisher having to do less work to "repair" the damage caused by the scrubbing. As a result, the burnisher can achieve a higher level of gloss with a given amount of energy input. The use of a cylindrical, bristled brush is the preferred scrubbing element in the practice of the present invention. A cylindrical brush permits the construction of a more compact cleaning device. Further, performance is enhanced because such a brush causes substantially linear striations in the floor coating rather than the random striations caused by a rotating, circular non-woven pad as is conventionally used. It appears that these linear striations may result in a surface that is more readily burnished to a high level of gloss.

The preferred brushes for use in the present invention are brushes having polymeric bristles, such as polypropylene or nylon bristles. The bristles typically range from about 0.1 mm to about 0.5 mm in diameter and most preferably from about 0.15 mm to about 0.35 mm. If they are substantially thicker, they are too stiff to give the best results in the present invention. If they are substantially thinner than 0.1 mm, the bristles do not have sufficient body to clean effectively.

The burnishing pad useful in the practice of the present invention can be any of the non-woven, polymeric, for example nylon, burnishing pads that are commonly used. A preferred pad is a nylon pad sold by ETC of Henderson, Inc. of Henderson, N.C. under the designation "Blue Jay".

In the practice of the present invention it has been found that an acrylic floor coating can be cleaned and burnished with good effect by the use of the Multi-operation cleaning device and method of the present invention when compared with a conventional scrubbing and burnishing operation. As shown in the Table below a floor cleaning method and device having sweeping, scrubbing and burnishing mechanisms on a single platform according to the present invention (Example "A") was compared with a conventional process using an autoscrubbing machine and propane-powered burnishing device (Example "B"). The device of the present invention (Example "A") was used with a cylindrical soft, polymeric bristled brush having bristles about 0.35 mm in diameter and rotating at 900 rpm. The machine was tested with two different burnishing pads. The first was a conventional, nonwoven, nylon fiber burnishing pad available commercially from ETC corporation and identified as a "Blue Jay" pad rotating at 2100 rpm. The machine was also tested using a second type of burnishing pad that has been shown to give the best results with the conventional propane burnisher. The device was constructed such that the front of the burnishing pad was located about 20 cm behind the rear point of contact of the scrubbing brush with the floor.

The floor finish was an acrylic floor finish liquid available under the Premia brand, a widely used acrylic polymer floor finish commercially available from Johnson Wax Professional of Sturtevant, Wis. The washing liquid was Accumix UHS cleaner also commercially available from Johnson Wax Professional and used at a dilution of 1 ounce per 8 gallons of water (I part cleaner per 1024 parts water).

The conventional equipment (Example "B") was a conventional sweeping and scrubbing machine using a nylon bristle scrubbing pad (Red pad) widely used in the industry and using the same scrubbing liquid as identified above. The burnisher was a conventional 27 inch (69 cm) propane burnisher manufactured by A. L. Cook and using the same Gorilla Lite burnishing pad as used on the device of the present invention and rotated at 2000 rpm. The test floor was first scrubbed to simulate the wear of normal traffic and to provide a base line gloss measure and then the test was performed. The test floor was then scrubbed in the conventional manner with an autoscrubber using red pads traversing the floor at a speed of 1.5 feet per second (46 cm per sec). After waiting one-half hour after scrubbing (which is a representative delay experienced when a single operator first scrubs and then burnishes a reasonable sized floor) the floor was then burnished with the propane burnisher moving at the rate of about 2 feet per second (61 cm per second). The gloss was measured using a Gardner 20 degree gloss meter and the readings are shown in the Table below. Separately, the test floor was again scrubbed to establish a baseline and then scrubbed and burnished with the cleaning device of the present invention traversing the floor at the rate of 1.7 feet per second (52 cm per second). The averaged measurements are shown in the Table.

TABLE

| | 20 DEGREE GLOSS MEASUREMENT | |
|---|---|---|
| | Same Pads - Test 1 | Unique Pads - Test 2 |
| Example "A" | | |
| Baseline | 32 | 26 |
| Final Gloss | 71 | 77 |
| Increase | 39 | 51 |
| Example "B" | | |
| Baseline | 31 | 25 |
| Final Gloss | 64 | 57 |
| Increase | 33 | 32 |

Test 1 = Both burnishers using "Gorilla Lite" pads
Test 2 = Propane Burnisher using Gorilla Lite pad and example "A" using "Blue-Jay" pad.

These tests show that the 20 degree gloss is 5 to 10 points higher using the method and device of the present invention (Example "A") compared to a conventional scrubbing and burnishing operation (Example "B"). This result is true even in Test 1 where the burnishing pad which performs best in the conventional propane burnisher is used in both machines. Test 1 shows that the increase in gloss above the baseline by the method and device of the present invention is 6 points better than the conventional process. In Test 2 where the best pad for each burnisher is used, the device of the present invention obtained 51 points increase in gloss versus 32 points increase for the conventional process and achieved a gloss rating of 77 versus 57 for the conventional process.

It is to be understood that while the invention has been described in conjunction with the detailed description thereof, the foregoing description is intended to illustrate and not limit the scope of the invention, which is defined by the scope of the appended claims. Other aspects, advantages, and embodiments are within the scope of the following claims.

What is claimed is:

1. A cleaner for cleaning a floor comprising a first assembly of components for performing a first cleaning operation on the floor, a second assembly of components for performing a second cleaning operation on the floor, control circuitry, connected to the first and second assemblies, executing in parallel a first program module operating the first assembly and a second program module operating the second assembly, wherein the first program module supplies data to the second program module, and the second program module modifies the operation of the second assembly based on said data.

2. A cleaner for cleaning a floor comprising a first assembly of components for performing a first cleaning operation on the floor, a second assembly of components for performing a second cleaning operation on the floor, control circuitry connected to the first and second assemblies, executing in parallel a first program module operating the first assembly and a second program module operating the second assembly, wherein the control circuitry comprises at least two processors, one processor executing the first program module and a second processor executing the second program module.

3. A cleaner for cleaning a floor comprising a first assembly of components for performing a first cleaning operation on the floor, a second assembly of components for performing a second cleaning operation on the floor, control circuitry, connected to the first and second assemblies, executing in parallel a first program module operating the first assembly and a second program module operating the second assembly, wherein the first assembly includes a scrubber and the second assembly includes a burnisher.

4. The cleaner of claim 3 further comprising:

a third assembly of components for sweeping the floor, wherein the control circuitry is further connected to the third assembly and executes, in parallel with the first and second program modules, a third program module operating the third assembly.

5. A cleaner for cleaning a floor comprising a first assembly of components for performing a first cleaning operation on the floor, a second assembly of components for performing a second cleaning operation on the floor, control circuitry, connected to the first and second assemblies, executing in parallel a first and second program modules, the first program module comprising a first plurality of instructions for controlling the operations of the first and second assemblies and coordinating among the operations of the first and second assemblies, the second program module comprising a second plurality of instructions for controlling the operations of the first and second assemblies, wherein the first plurality of instructions includes an instruction for supplying a command from the first program module to the second program module, the command requiring performance of a sequence of actions by at least one of the first and second assemblies, wherein the first program module, after executing the instruction for supplying the command, executes other instructions independent of performance of said sequence of actions, the second plurality of instructions including a sequence of instructions for causing said at least one of the first and second assemblies to perform said sequence of actions, the second program module executing the sequence of instructions independent of the first program module.

6. The cleaner of claim 5 wherein the control circuitry comprises at least two processors, one processor executing the first program module and a second processor executing the second program module.

7. The cleaner of claim 5 wherein the first assembly includes a scrubber and the second assembly includes a burnisher.

8. The cleaner of claim 7 further comprising:

a third assembly of components for sweeping the floor, wherein the control circuitry is further connected to the third assembly, wherein the first program module further comprises a third plurality of instructions for operating the third assembly and coordinating among the operations of the third assembly, and the first and second assemblies, wherein the second program module further comprises a fourth plurality of instructions for operating the third assembly, wherein the second plurality of instructions includes an instruction for supplying a second command from the first program module to the second program module, the command requiring performance of a second sequence of actions by the third assembly, wherein the first program module, after executing the instruction for supplying the second command, executes other instructions independent of performance of said second sequence of actions, the second plurality of instructions including a second sequence of instructions for causing the third assembly to perform said second sequence of actions, the second program module executing the second sequence of instructions independent of the first program module.

9. A cleaner comprising a first assembly of components for performing a first cleaning operation, a second assembly of components for performing a second cleaning operation, control circuitry, connected to the first and second assemblies, coordinating an operation of the first assembly relative to an operation of the second assembly based on a distance traveled by said cleaner.

* * * * *